US008590884B2

(12) United States Patent
Maruta et al.

(10) Patent No.: US 8,590,884 B2
(45) Date of Patent: Nov. 26, 2013

(54) IMAGE FORMING APPARATUS WITH TIMER PART

(75) Inventors: Masaaki Maruta, Osaka (JP); Satoru Nakamura, Osaka (JP)

(73) Assignee: Kyocera Document Solutions, Inc., Osaka (JP)

( * ) Notice: Subject to any disclaimer, the term of this patent is extended or adjusted under 35 U.S.C. 154(b) by 0 days.

(21) Appl. No.: 13/559,843

(22) Filed: Jul. 27, 2012

(65) Prior Publication Data

US 2013/0026699 A1 Jan. 31, 2013

(30) Foreign Application Priority Data

Jul. 28, 2011 (JP) ..... 2011-165428

(51) Int. Cl.
*B65H 5/06* (2006.01)
*B65H 7/18* (2006.01)

(52) U.S. Cl.
CPC ..... *B65H 7/18* (2013.01)
USPC ..... 271/10.03; 271/10.12; 271/227; 271/242; 399/395

(58) Field of Classification Search
USPC ..... 271/10.03, 10.12, 110, 227, 228, 242; 399/395
See application file for complete search history.

(56) References Cited

U.S. PATENT DOCUMENTS

| | | | | |
|---|---|---|---|---|
| 5,738,349 | A * | 4/1998 | Shirasaki | 271/242 |
| 7,810,808 | B2 * | 10/2010 | Hamahashi | 271/242 |
| 2010/0262277 | A1 * | 10/2010 | Kondo | 271/227 |
| 2011/0037221 | A1 * | 2/2011 | Wiegmann | 271/270 |
| 2012/0248677 | A1 * | 10/2012 | Nakamura et al. | 271/10.01 |

FOREIGN PATENT DOCUMENTS

JP 2003-206039 A 7/2003

OTHER PUBLICATIONS

English Abstract and Machine Translation for JP 2003-206039 A, published Jul. 22, 2003.

* cited by examiner

*Primary Examiner* — Gerald McClain
(74) *Attorney, Agent, or Firm* — NDQ&M Watchstone LLP

(57) ABSTRACT

An image forming apparatus comprises an image-forming part; a paper feeding part; a resist part; a rotating body; a detector for detecting the arrival of paper at the resist part; a timer part for measuring a measurement time from when feeding of a second sheet of paper from the paper feeding part is begun to when the detector detects the arrival of the second sheet of paper, and a sheet interval time from when the detector detects the passage of a first sheet of paper immediately preceding the second sheet of paper to when the arrival of the second sheet of paper is detected; and an identifier part for referring to the measurement time, a reference measurement time, the sheet interval time and a reference sheet interval time, and deciding the paper feeding part advancing or delaying the paper feed start timing.

13 Claims, 11 Drawing Sheets

FIG.7

| PRINTER PAPER SIZE | PRINTER PAPER TYPE | REFERENCE MEASUREMENT TIME (ms) | REFERENCE SHEET INTERVAL TIME(ms) |
|---|---|---|---|
| A4 VERTICAL | REGULAR STOCK | R11 | R21 |
| | LIGHT STOCK | R12 | R22 |
| | HEAVY STOCK | R13 | R23 |
| | ⋮ | ⋮ | ⋮ |
| | COATED PAPER | R1m | R2m |
| ⋮ | ⋮ | ⋮ | ⋮ |
| LETTER SIZE | REGULAR STOCK | R14 | R24 |
| | LIGHT STOCK | R15 | R25 |
| | HEAVY STOCK | R16 | R26 |
| | ⋮ | ⋮ | ⋮ |
| | COATED PAPER | R1n | R2n |

IMAGE FORMING APPARATUS WITH TIMER PART

This application is based upon and claims the benefit of priority from the corresponding Japanese Patent Application No. 2011-165428 filed Jul. 28, 2011, the entire contents of which are incorporated herein by reference.

BACKGROUND

1. Field

The present disclosure relates to an image forming apparatus such as a printer, multifunction machine, photocopier, facsimile apparatus, or the like including a resist part for curling and sending out paper.

2. Description of Related Art

An image forming apparatus has a paper feeding part (for example, a paper cassette) for accommodating a plurality of sheets of paper. The image forming apparatus conveys paper supplied from the paper feeding part, and forms an image on the paper. A roller or the like is provided in a conveyance path for conveying the paper. At this time, the risk of delays in paper feeding or paper conveying from roller slippage, reduced conveying capacity due to roller wear, or the like arises. Delays in feeding or conveying the paper reduce the productivity of the image forming apparatus. In regard whereto, there are known paper conveying apparatuses used to ensure productivity despite diminished roller conveying ability.

Specifically, there is known a paper conveying apparatus having a paper sensor for detecting whether paper is present in a paper conveying part, the apparatus configured so as to measure a time T from when a paper feeding start signal is given to when the paper sensor detects the leading end of the paper during paper feeding, compare the detected time T to a predetermined value T0 set in advance when two or more sheets of paper are continuously fed, and perform a control so that the timing at which paper feeding of the second and subsequent sheets of paper is begun is advanced by an amount of time equal to T-T0. Such a configuration advances the timing at which paper feeding begins by the amount of time equal to T-T0, thereby attempting to prevent increases in roller slippage over time and reductions in paper line speed.

An image forming apparatus may be provided with a resist part (resist roller pair) upstream of an image-forming part in the paper conveyance direction. The resist part sends out paper at a suitable timing The resist part is also used, for example, to correct improperly squared (skewed) paper. Specifically, the leading end of the paper strikes the stopped resist part. Curl is then generated by continuing paper conveyance on the following end side of the paper. The elasticity of the bent paper forces the leading end of the paper to line up with the nip formed by the resist part, correcting the skew of the paper.

Conventionally, the curl of the paper is generated by stopping the resist part and continuing to convey the leading end side of the paper using a paper feeding roller or a conveying roller (intermediate roller) located one position upstream of the resist part.

In the paper conveying apparatus described above, the timing at which paper feeding is begun is advanced only on the basis of the detected time T. However, the position of the paper within the paper feeding part may vary. For example, the next sheet of paper may be dragged along due to friction from the previous sheet of paper, so that the paper is fed with the position of its leading end shifted towards the downstream side of the paper conveyance direction. When the paper in the paper feeding part is fed with the position of its leading end shifted towards the downstream side of the paper conveyance direction, the paper feeding reaches the resist part prematurely. When this happens, any delay in paper conveyance is cancelled out by the feeding and conveyance of the paper having begun from a downstream-shifted position. As a result, no delay or advance in paper conveying may be determined to be present.

Correction of the paper feeding start timing according to the method of the paper conveying apparatus described above is greatly affected by variations in the position of the leading end of the paper in the paper feeding part, with no consideration whatsoever being given to the sheet interval of the conveyed paper. There is thus the problem that delays or advances in the timing at which the paper arrives at the resist part cannot be correctly determined. The correction performed by the paper conveying apparatus described above is also greatly affected by variations in the position of the leading end of the paper in the paper feeding part. There is the problem that such paper feeding start timing correction may create a sheet interval that is too small.

SUMMARY

The present disclosure was contrived in view of the problems in the prior art described above, and discloses accurately determining delays or advances in the timing at which paper arrives at the resist part while also taking sheet interval into account, and correcting the paper feeding start timing on the basis of the accurate determination results and causing the paper to always arrive at the resist part at the proper timing so as to ensure productivity.

In order to resolve the above problems, an image forming apparatus according to a first aspect of the present disclosure includes an image-forming part for forming an image upon paper; a resist part for conveying paper towards the image-forming part; a paper feeding part accommodating a plurality of sheets of paper and having a paper feeding rotating body, the paper feeding rotating body being rotated so as to send paper out towards the resist part; a detector for detecting the arrival of paper at the resist part, the detector being provided upstream of the resist part in the paper conveyance direction; a timer part for measuring a measurement time from when feeding of a second sheet of paper from the paper feeding part is begun to when the detector detects the arrival of the second sheet of paper, and a sheet interval time from when the detector detects the passage of a first sheet of paper immediately preceding the second sheet of paper to when the arrival of the second sheet of paper is detected; and an identifier part for referring to the measurement time and a predetermined reference measurement time acting as a reference for the measurement time, referring to the sheet interval time and a predetermined reference sheet interval time acting as a reference for the reference sheet interval time, deciding upon a correction to be performed upon the paper feed start timing, and delaying or advancing the paper feed start timing with respect to the current paper feed start timing for the paper feeding part on the basis of the decided-upon correction to be performed.

Further features and advantages of the present disclosure will become apparent from the description of embodiments given below.

BRIEF DESCRIPTION OF THE DRAWINGS

FIG. 7 is an illustration of an example of data used to correct paper feed start timing in the printer according to the first embodiment.

DETAILED DESCRIPTION

There follows a description of embodiments of the present disclosure with reference to FIGS. 1 through 11. A first embodiment will first be described with reference to FIGS. 1 through 7. However, the elements of the configurations, arrangements, or the like described in the embodiments are merely for the sake of illustration, and in no way limit the scope of the disclosure.

(Outline of an Image Forming Apparatus)

Figure 1:
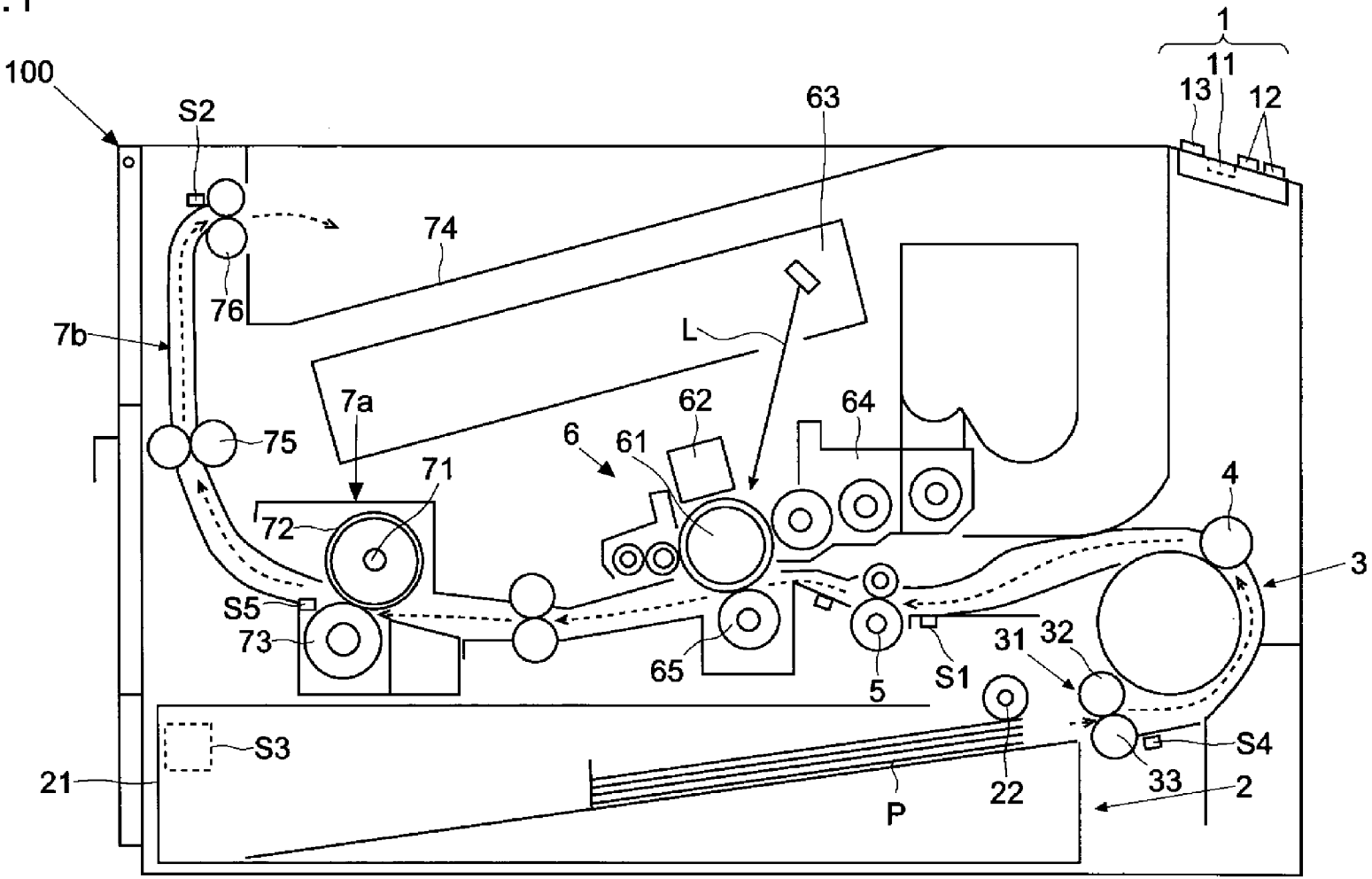
FIG. 1 is a schematic left side sectional view of an outline of the structure of a printer.

First, the first embodiment will be described. The following description of the embodiment features an electrophotographic digital printer 100 as an example of an image forming apparatus. FIG. 1 is a schematic left side sectional view of an outline of the structure of the printer 100.

As shown in FIG. 1, an operating panel 1 (corresponding to an input part) is provided on an upper part of the front side of the printer 100. The operating panel 1 has an LCD 11 (corresponding to an alert-issuing part) for displaying the status of the printer 100 and various messages. The operating panel 1 is also provided with an operating key 12 for setting various functions (for example, the size of paper being used for printing and the paper thickness) of the printer 100, an indicator 13 (corresponding to an alert part) that lights up and goes out according to the status (executing job, error, or the like) of the printer 100, and the like.

As shown in FIG. 1, a paper feeding part 2 is disposed in the lower part of the interior of the main body of the printer 100. The paper feeding part 2 includes a removable cassette 21. A plurality of sheets of paper P can be loaded into the cassette 21. A paper feeding roller 22 (corresponding to a paper feeding rotating body) is provided in the paper feeding part 2. The paper feeding roller 22 contacts the topmost sheet of the loaded paper P and is rotatably driven. When the paper feeding roller 22 is driven, the paper P is sent out of the cassette 21.

A conveyance part 3 is connected downstream of the paper feeding part 2 in the paper conveyance direction. The conveyance part 3 conveys the paper P supplied from the paper feeding part 2 towards an image-forming part 6. In order from the upstream side, a pickup part 31, an intermediate roller pair 4 (corresponding to a rotating body), and a resist roller pair 5 (corresponding to a resist part) are disposed in the conveyance part 3.

Two or more overlapping sheets of paper P may be sent out from the paper feeding part 2 (overlapping feeding) due to factors such as friction between sheets of paper, static electricity generated by friction, or paper sticking caused by the paper absorbing moisture. The pickup part 31 of the conveyance part 3 prevents paper feed overlap. The pickup part 31 includes a pair of rollers. An upper roller 32 on the upper side of the pickup part 31 is rotatably driven so as to send paper P in the direction of the image-forming part 6. Meanwhile, a lower roller 33 on the lower side rotates in a direction sending the paper P back to the paper feeding part 2. The lower roller 33 sends overlapped sheets of paper P back to the paper feeding part 2, preventing paper feed overlap.

The intermediate roller pair 4 conveys the paper P towards the resist roller pair 5, the image-forming part 6, and the like. The resist roller pair 5 then corrects any skewing in the paper P (details below). The resist roller pair 5 then sends the paper P towards the image-forming part 6 timed so as to coincide with the formation of a toner image upon the image-forming part 6.

The printer 100 according to the present embodiment is also provided with a resist sensor S1 (corresponding to a detector). The resist sensor S1 is provided downstream of the intermediate roller pair 4, and upstream and in the vicinity of the resist roller pair 5. The resist sensor S1 is used, for example, to time the arrival of the paper P in the vicinity of the resist roller pair 5, the beginning of the rotation of the resist roller pair 5, and the like. As a rule, the resist roller pair 5 begins rolling after a predetermined curl generation time W1 has passed after the resist sensor Si detects the arrival of the paper.

Next, the formation of a toner image on the image-forming part 6 will be described. The image-forming part 6 is provided with a photosensitive drum 61 that rotates at a predetermined speed and bears a toner image. An electrostatic part 62 imparts the photosensitive drum 61 with a constant electrostatic potential. An exposure part 63 then directs laser light L upon the photosensitive drum 61 on the basis of image data, print settings data, or the like sent to the printer 100 by a computer 200 (cf. FIG. 2). As a result, a latent electrostatic image is formed on the surface of the photosensitive drum 61. A developer device 64 supplies toner to the latent electrostatic image. The toner image is thereby developed. A transfer roller 65 pressing upon the photosensitive drum 61 is also provided. When the toner image and paper P advance into the nip formed by the transfer roller 65 and the photosensitive drum 61, a transfer voltage is applied to the transfer roller 65. The toner image is thereby transferred to the paper P.

A fuser part 7*a* is provided downstream of the image-forming part 6 in the paper conveyance direction. The fuser part 7*a* includes a heating roller 72 with an internal heat generator 71, and a pressure roller 73 pressing against the heating roller 72 to form a nip. The paper P bearing the unfused toner image is sent to the fuser part 7*a*, advancing into the nip. The paper P with the transferred image is thereby heated and compressed, and the toner is fused to the paper P. Afterwards, the paper P is sent upwards through a discharge conveyance part 7*b*, and ejected into a discharge tray 74 on the uppermost part of the printer body. A rotatably driven conveyor roller pair 75 and ejector roller pair 76 for conveying the paper P towards the discharge tray 74 are provided in the discharge conveyance part 7*b*.

(Hardware Configuration of the Printer 100)

Figure 2:
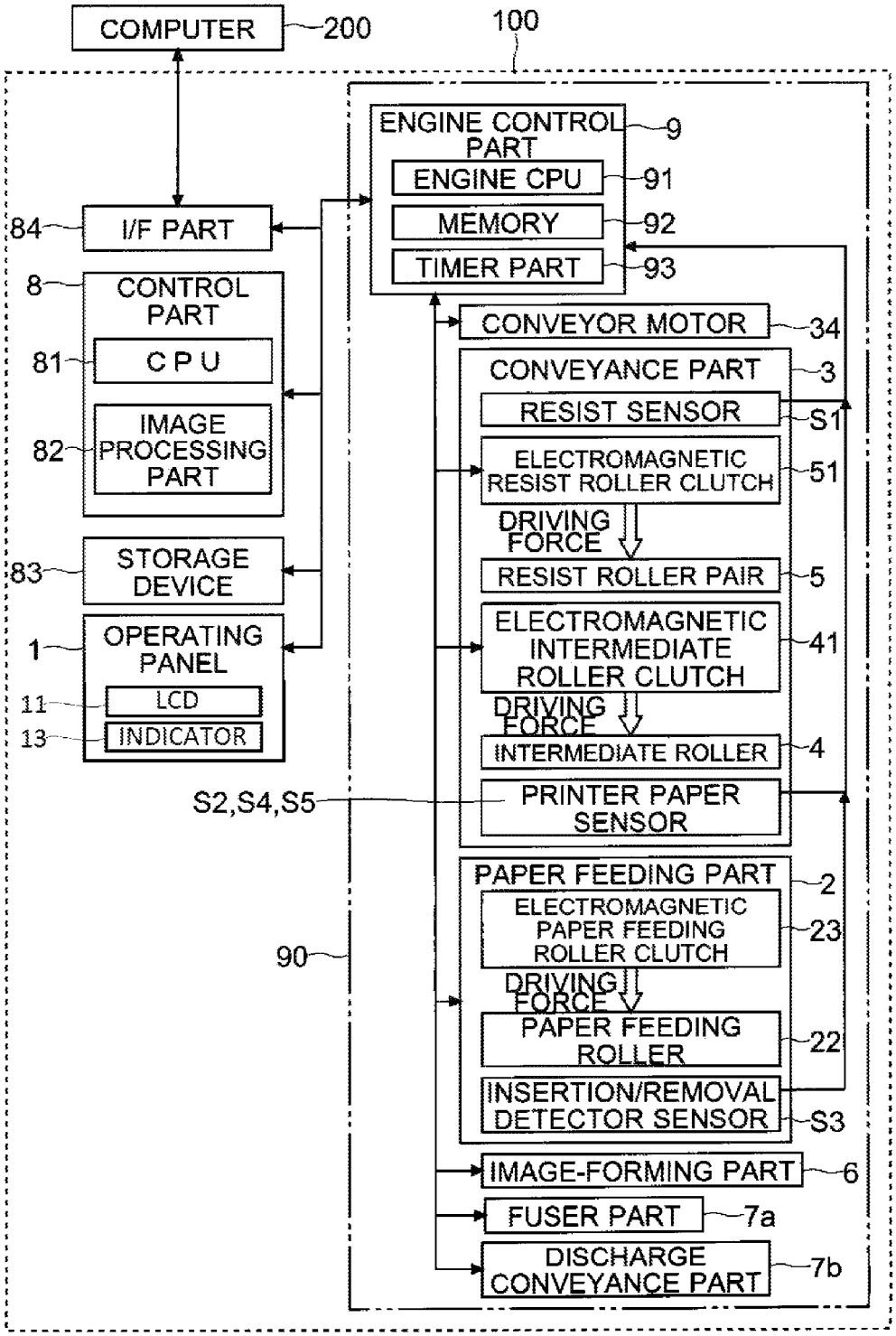
FIG. 2 is a block diagram illustrating one example of the hardware configuration of a printer.

Next, the hardware configuration of the printer 100 according to the embodiment will be described with reference to FIG. 2. FIG. 2 is a block diagram illustrating one example of a hardware configuration of the printer 100.

As shown in FIG. 2, the printer 100 according to the present embodiment has a control part 8 within the interior thereof The control part 8 manages overall operation, controls communication, performs image processing, and is in charge of controlling the various parts of the printer 100. The control part 8 is, for example, a circuit board including a CPU 81, an image processing part 82, and the like.

The control part 8 is connected to a storage device 83 (corresponding to a storage part). The storage device 83 is a combination of volatile and non-volatile memory devices such as ROM, RAM, flash ROM, an HDD, and the like. The storage device 83 stores, for example, control programs and control data for the printer 100. The CPU 81 is a central processing device. The CPU 81 performs processing and control of the various parts of the printer 100 on the basis of the control programs and settings data stored within the storage device 83.

The image processing part 82 is a circuit including an ASIC, image processing RAM, and the like. The image processing part 82 performs various types of image processing, such as magnification, reduction, density changes, and data format changes, upon image data according to the settings. The image processing part 82 then sends the processed image data to the exposure part 63. The exposure part 63 receives the image data, performs scanning and exposure, and forms a latent electrostatic image on the photosensitive drum 61.

The control part 8 is connected to the operating panel 1. The control part 8 recognizes inputs made using the operating panel 1. The control part 8 also recognizes inputs made using the operating key 12. For example, the control part 8 recognizes paper size or paper type (thickness) settings entered using the operating key 12 of the operating panel 1. The control part 8 also controls the displays of the LCD 11 and indicator 13 of the operating panel 1. For example, when an error such as a paper jam occurs, the control part 8 lights up the indicator 13, causing the indicator to show that an error has occurred.

The control part 8 is also connected to an I/F part 84 (corresponding to an input part). The I/F part 84 is a communications interface for communicating via a network, cable, or the like with the computer 200 (for example, a personal computer, server, or the like) from which the printing data, including image data for printing and print settings data, is sent. The printer 100 performs printing on the basis of the image data and print settings data from the computer 200 inputted using the I/F part 84. The data received by the I/F part 84 includes data designating the paper size and paper type (thickness) to be used during printing. The I/F part 84 accepts inputs designating the paper size and paper type to be used during printing.

An engine control part 9 (corresponding to an identifier part/drive controller) for controlling engine part 90 (for example, an engine part 90 includes the paper feeding part 2, the conveyance part 3, the image-forming part 6, the fuser part 7*a*, and the discharge conveyance part 7*b*) of the printer 100 related to image formation is provided within the printer. The engine control part 9 is, for example, a circuit board including an engine CPU 91, memory 92, a timer part 93, and the like.

The engine CPU 91 is an arithmetic processing unit for performing processing on the basis of programs and data within the memory 92. The memory 92 is ROM or RAM for storing control programs or data related to image formation. For example, programs or data for correcting the paper feed start timing of the paper feeding part 2 are stored within the memory 92. The timer part 93 measures control-related time periods. Timing may also be performed by the engine CPU 91.

The engine control part 9 controls the operation of the various parts of the engine part 90 on the basis of the printing-related control programs or control data stored in the memory 92 so that image formation is properly performed. In the example of the present embodiment, a dedicated image forming engine control part 9 is provided separately from the control part 8, but the engine control part 9 and the control part 8 may also be combined, and the control part 8 made to perform the functions and processes of the engine control part 9.

The engine control part 9 is responsible for controlling printing-related processes; for example, switching on or off motors or the like for the rotating bodies of the paper feeding part 2, conveyance part 3, image-forming part 6, fuser part 7*a*, and discharge conveyance part 7*b*, controlling the supply and conveyance of the paper; controlling the formation of toner images upon the image-forming part 6; and controlling the fusing temperature of the fuser part 7*a*.

As shown in FIG. 2, the conveyance part 3 is provided with, for example, the above-described resist sensor S1, intermediate roller pair 4, and resist roller pair 5 related to conveying the paper. A conveyor motor 34 for supplying drive power to the above rotating bodies is provided. The engine control part 9 controls the rotation of the conveyor motor 34, and causes the conveyor motor 34 to rotate when the paper P needs to be conveyed.

The resist sensor S1 is, for example, an optical sensor. A reflective optical sensor having a light emitter part for directing light towards the conveyance part 3 and a light receiver part for receiving light reflected by the paper P can be used as the optical sensor. A transmitting optical sensor having a light emitter part, a light receiver part, and an actuator moving in contact with the conveyed paper P can also be used as the optical sensor. In the case of a transmitting optical sensor, for example, the actuator blocks light traveling from the light emitter part to the light receiver part when paper P has not arrived or is not passing by; when paper P has arrived or is passing by, the position of the actuator changes, allowing light from the light emitter part to reach the light receiver part, leading to a change in output. A type of sensor other than an optical sensor may be used provided that it is capable of detecting the arrival or passage of the paper P.

The output (output voltage value) of the resist sensor S1 thus changes depending upon whether the presence of paper P is or is not detected. The output of the resist sensor S1 is inputted to the engine control part 9. The engine control part 9 is capable of recognizing whether the paper P has arrived at the position of the resist sensor S1, or whether the paper has passed by after arriving, on the basis of the output (for instance, high or low) from the resist sensor S1.

An electromagnetic resist roller clutch 51 for switching transmission of driving force from the conveyor motor 34 to the resist roller pair 5 on or off is also provided. The engine control part 9 causes the conveyor motor 34 to rotate so that the resist roller pair 5, intermediate roller pair 4, and the like rotate at a predetermined speed. The engine control part 9 emits a signal indicating whether to rotate or to stop rotating to the electromagnetic resist roller clutch 51, controlling the rotation of the resist roller pair 5. When the engine control part 9 rotates the resist roller pair 5, the electromagnetic resist roller clutch 51 is switched on while the conveyor motor 34 is rotated. The resist roller pair 5 thereby rotates. When the engine control part 9 stops the resist roller pair 5, either the conveyor motor 34 is stopped or the electromagnetic resist roller clutch 51 is switched off. The resist roller pair 5 is thereby kept in a stopped state.

An electromagnetic intermediate roller clutch 41 for switching on or off transmission of driving force from the conveyor motor 34 to the intermediate roller pair 4 is also provided. The engine control part 9 emits a signal indicating whether to rotate or to stop rotating to the electromagnetic intermediate roller clutch 41, controlling the rotation of the intermediate roller pair 4. When the engine control part 9 rotates the intermediate roller pair 4, the electromagnetic intermediate roller clutch 41 is switched on while the conveyor motor 34 is rotated. The intermediate roller pair 4 thereby rotates. When the engine control part 9 stops the intermediate roller pair 4, either the conveyor motor 34 is stopped or the electromagnetic intermediate roller clutch 41 is switched off The intermediate roller pair 4 thereby stops.

The paper feeding part 2 is also provided with, for example, an electromagnetic paper feeding roller clutch 23 related to paper feeding, as shown in FIG. 2. Driving force is transmitted from the conveyor motor 34 via a plurality of gears to the electromagnetic paper feeding roller clutch 23 (a separate motor may also be provided for the paper feeding roller). The engine control part 9 causes the conveyor motor 34 to rotate when the paper P needs to be fed.

The electromagnetic paper feeding roller clutch 23 is adapted for switching on and off the transmission of driving force from the conveyor motor 34 to the paper feeding roller 22. The engine control part 9 emits a signal indicating whether to rotate or to stop rotating to the electromagnetic clutch for the paper feeding roller 22, controlling the rotation of the paper feeding roller 22. When the engine control part 9 rotates the paper feeding roller 22, the electromagnetic paper feeding roller clutch 23 is switched on while the conveyor motor 34 is rotated. The paper feeding roller 22 thereby rotates. When the engine control part 9 stops the paper feeding roller 22, either the conveyor motor 34 is stopped or the electromagnetic paper feeding roller clutch 23 is switched off The paper feeding roller 22 thereby stops.

(Generating Curl in the Paper P)

Figure 3:
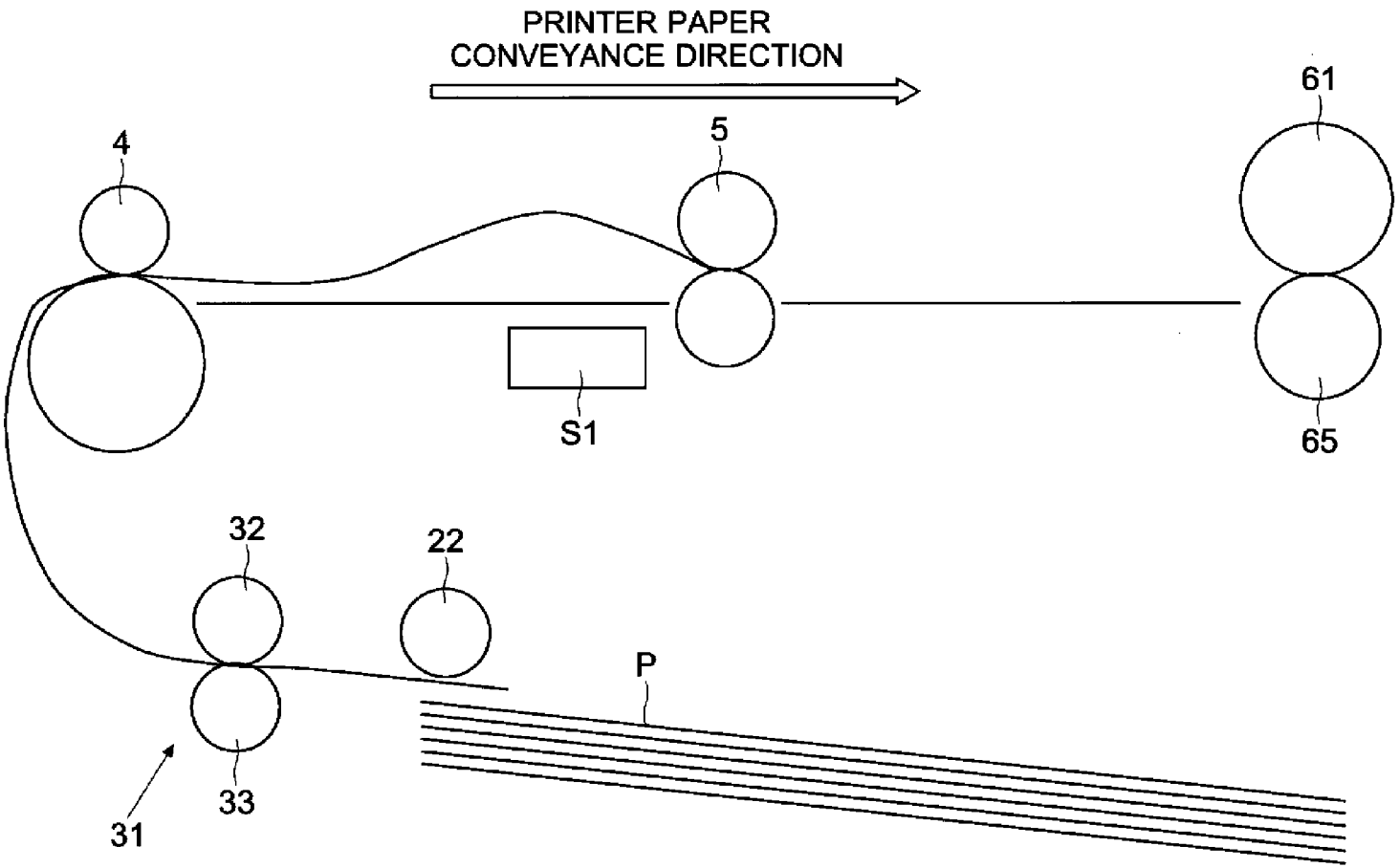
FIG. 3 is a drawing illustrating curl being generated in paper in a printer.

Next, a process of generating curl in the paper P of the printer 100 according to the first embodiment will be described with reference to FIG. 3. FIG. 3 is a drawing illustrating the generation of curl in paper P in the printer 100.

Specifically, FIG. 3 is a schematic representation of the conveyance path from the paper feeding part 2 to the image-forming part 6 (photosensitive drum 61 and transfer roller 65). In order from the upstream side in the paper conveyance direction, FIG. 3 depicts the paper feeding roller 22, pickup part 31, intermediate roller pair 4, resist sensor S1, resist roller pair 5, and image-forming part 6. FIG. 3 schematically depicts the relative positions of the various members, and the relative sizes of and distances between the various parts may differ from those in actuality.

In the printer 100, the engine control part 9 causes the intermediate roller pair 4 to convey the paper P while the paper is forced against the resist roller pair 5, curling the paper P. The process of generating curl in the paper P of the printer 100 according to the present embodiment will now be described with reference to FIG. 3.

The engine control part 9 rotates the paper feeding roller 22 and the intermediate roller pair 4, conveying the paper P toward the resist roller pair 5. The engine control part 9 then recognizes the arrival of the paper at the resist sensor S1 on the basis of the output of the resist sensor S1.

When the paper P has arrived at the resist sensor S1, the engine control part 9 puts the resist roller pair 5 into a stopped state. The leading end of the paper P is thereby forced against the resist roller pair 5. The engine control part 9 then causes the intermediate roller pair 4 to continue conveying the paper while leaving the resist roller pair 5 stopped. As a result, the elasticity of the curled paper P causes the leading end of the paper P to conform to the nip of the resist roller pair 5. Skew in the paper P is thereby corrected.

The intermediate roller pair 4 then continues to rotate regardless of whether the resist sensor S1 has detected the arrival of the paper or the resist roller pair 5 is stopped or rotating. In other words, barring any unusual circumstances, such as the sheet interval being too short, the intermediate roller pair 4 continues to rotate from the first page of a printing job until conveyance of the last page paper is complete. Once a predetermined curl generation time W1 has passed after the resist sensor S1 detects the arrival of the paper, the engine control part 9 rotates the resist roller pair 5.

Even when curl is generated in the paper P and the resist roller pair 5 rotates and sends out the paper P, the intermediate roller pair 4 does not stop. Any deviations in the amount of curl in the paper P arising from the intermediate roller pair 4, such as individual differences in the response speed of the electromagnetic intermediate roller clutch 41 or degradations in the response speed of the electromagnetic intermediate roller clutch 41 due to aging, are thereby eliminated. The engine control part 9 then begins image formation on the image-forming part 6 in response to the resist roller pair 5 beginning to rotate. It is thereby possible to accurately transfer the toner image to the desired position on the paper P.

(Timing and Time Measurement)

Figure 4:
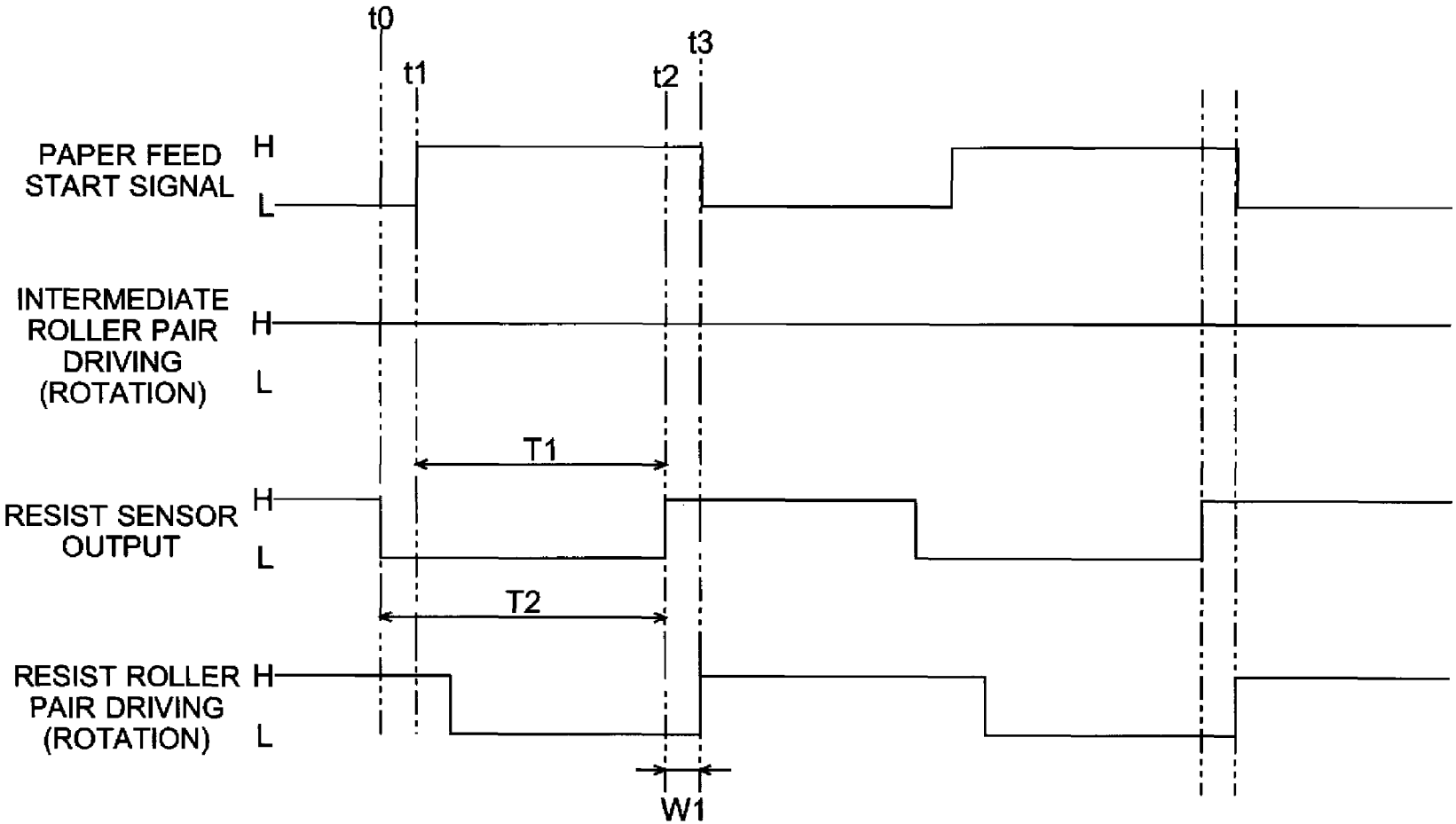
FIG. 4 is a chart illustrating paper feeding and paper conveyance timings in a printer according to a first embodiment.

Next, the measuring of time in order to correct the drive timings of the various parts and paper feed start timing of the printer 100 according to the first embodiment will be described with reference to FIG. 3 and FIG. 4. FIG. 4 is a chart illustrating paper feeding and paper conveyance timings in the printer 100 according to the first embodiment.

The first line at the top of FIG. 4 depicts a signal indicating to start or stop rotating the paper feeding roller 22 issued by the engine control part 9 to the electromagnetic paper feeding roller clutch 23. A high signal indicates rotation, and a low signal indicates stopping. Upon receiving the signal, the electromagnetic paper feeding roller clutch 23 switches between connecting and releasing a drive power transmission path from the conveyor motor 34 to the paper feeding roller 22.

The second line in FIG. 4 depicts a signal indicating to rotate or stop the intermediate roller pair 4 issued by the engine control part 9 to the electromagnetic intermediate roller clutch 41. A high signal indicates rotation, and a low signal indicates stopping. Upon receiving the signal, the electromagnetic intermediate roller clutch 41 switches between connecting and releasing a drive power transmission path from the conveyor motor 34 to the intermediate roller.

The third line from the top in FIG. 4 depicts changes in the output of the resist sensor S1. As shown in FIG. 4, the resist sensor S1 of the present embodiment outputs high when the presence of paper P is detected, and low when the presence of paper P is not detected. The positive/negative logic of the sensors may also be reversed.

The lowest line in FIG. 4 depicts a signal indicating to rotate or stop the resist roller pair 5 issued by the engine control part 9 to the electromagnetic resist roller clutch 51.

High indicates rotation, and low indicates stopping. Upon receiving the signal, the electromagnetic resist roller clutch 51 switches between connecting and releasing a drive power transmission path from the conveyor motor 34 to the resist roller pair 5.

Next, the timing charts will be described in terms of the passage of time. First, the engine control part 9 rotates the paper feeding roller 22 in order to convey paper (t1 in FIG. 4). While the paper is being conveyed (until one printing job is finished), the engine control part 9 continues to rotate the intermediate roller pair 4 (signal sent to the electromagnetic intermediate roller clutch 41 kept at high).

The paper P supplied from the paper feeding part 2 is conveyed by the intermediate roller pair 4. As a result, the paper P arrives at the resist sensor S1. The engine control part 9 recognizes changes in the output of the resist sensor S1, and recognizes when the paper has arrived at the resist sensor S1 (t2 in FIG. 4).

After the paper arrives at the resist sensor S1, the engine control part 9 keeps the resist roller pair 5 in a stopped state until a predetermined curl generation time W1 (the period between t2 and t3 in FIG. 4) has passed. The same amount of curl is thus imparted to the paper P at all times. Once the curl generation time W1 has passed after the resist sensor S1 detects the arrival of the paper, the engine control part 9 rotates the resist roller pair 5 (t3 in FIG. 4). When continuous printing is performed, a cycle of paper feeding→arrival at resist sensor S1→waiting for allotted waiting period (curl generated by waiting for curl generation time W1)→resist roller pair 5 switched on is repeated.

Next, a process of measuring time for correcting paper feed start timing will be described. The time from when the signal directing the paper feeding roller 22 to begin rotating (paper feed start signal) is issued to when the resist sensor S1 detects the arrival of the paper (measurement time T1, the time from t1 to t2 in FIG. 4) is measured. The time from when the resist sensor S1 detects the passage of the paper (i.e., detects the following end of the paper) to when the arrival of the next sheet of paper (i.e., the leading end of the paper is detected) is also measured (sheet interval time T2, the time from t0 to t2 in FIG. 4). The measurement time T1 and sheet interval time T2 are measured by, for example, the engine control part 9 of the timer part 93.

The engine control part 9 then functions, for example, as an identifier part, using the measured measurement time T1 and sheet interval time T2 to decide upon the correction to be performed of the paper feed start timing to be performed against delays or advances in the arrival of the paper at the resist roller pair 5.

(Outline of Identifying Delays and Advances in Paper Arrival)

Figure 5:
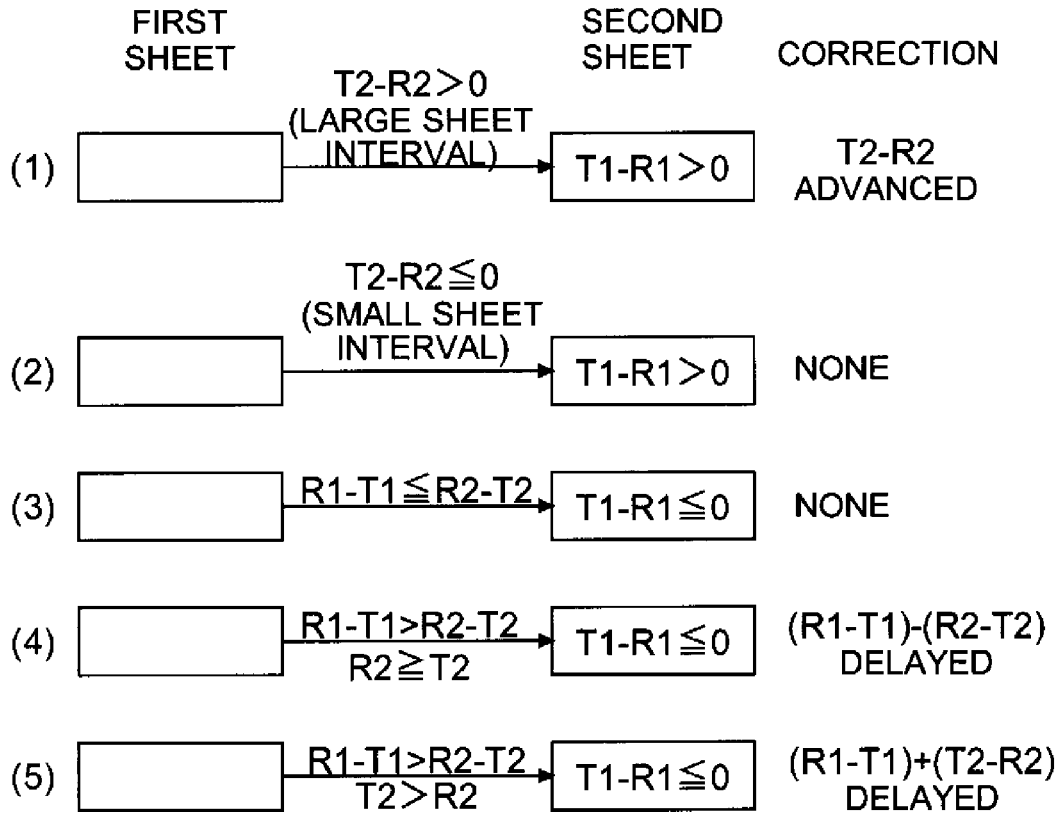
FIG. 5 is a conceptual illustration for determining delays or advances in paper arrival in the printer according to the first embodiment.

Next, a process of identifying paper delays and advances in the printer 100 according to the first embodiment will be described with reference to FIG. 5. FIG. 5 is a conceptual illustration for determining delays or advances in paper arrival in the printer 100 according to the first embodiment. In the following description, the sheet of paper P whose arrival at the resist sensor S1 after paper feeding begins will be referred to as the "second sheet of paper," and the sheet of paper P conveyed immediately prior to the second sheet of paper (the sheet of paper P positioned ahead of the second sheet of paper) will be referred to as the "first sheet of paper." In this case, the paper is conveyed in the order first sheet of paper→second sheet of paper.

Using the measurement time T1 of the second sheet of paper and the sheet interval time T2 between the sheet of paper P for which the measurement time T1 was measured (the second sheet of paper) and the sheet of paper P one sheet prior to the sheet of paper P for which the measurement time T1 was measured (the first sheet of paper), it is decided whether correction of the paper feed start timing is necessary, and, if so, to what extent.

Specifically, the engine control part 9 decides whether correction of the paper feed start timing is necessary, and, if so, to what extent, on a case-by-case basis depending on whether the time needed from when the signal to start feeding the second sheet of paper is issued to when the second sheet of paper arrives at the resist sensor S1 (i.e., the measurement time) is longer than a reference measurement time (reference measurement time R1).

The following symbols (labels) will be used in the following descriptions of each case.

T1: measurement time (the time actually measured from when the paper feed start signal for the second sheet of paper is given to when the arrival of the paper at the resist sensor S1 is detected)

R1: reference measurement time (theoretically ideal measurement time)

T2: sheet interval time (the time actually measured from when the resist sensor S1 detects the passage of the first sheet of paper to when the arrival of the second sheet of paper is detected)

R2: reference sheet interval time (theoretically ideal sheet interval time)

[Cases in Which the Arrival of the Second Sheet of Paper is Delayed (T1−R1>0)]

First, the engine control part 9 identifies whether or not the second sheet of paper (sheet of paper coming after the first sheet of paper) is delayed with respect to the reference measurement time R1 on the basis of the following formula (1).

T1−R1 (Actually measured measurement time−reference measurement time) (Formula 1)

When T1−R1 is greater than zero (T1 is greater than R1; i.e., formula 1 results in a positive value), the engine control part 9 identifies the arrival of the second sheet of paper as being delayed. On the basis of the identification results for the second sheet of paper, it is decided whether correction of the paper feed start timing is necessary, and, if so, to what extent.

When the arrival of the second sheet of paper is delayed (when T1−R1 is greater than zero), the engine control part 9 next performs a calculation according to the following formula (2).

T2−R2 (actually measured sheet interval time−reference sheet interval time) (Formula 2)

When the sheet interval between the first sheet of paper and the second sheet of paper is greater than the ideal sheet interval (T2−R2 is greater than zero; i.e., T2 is greater than R2), the engine control part 9 decides to advance the paper feed start timing of the paper feeding roller 22 by the difference (T2−R2). As a result of the engine control part 9 setting this correction to be performed, the engine control part 9 causes the paper feeding roller 22 to feed the sheet of paper following the second sheet of paper at a paper feed start timing that is sooner than that for the second sheet of paper by the amount (T2−R2); i.e., paper feeding is begun sooner. Because the sheet interval between the second sheet of paper and the sheet of paper following the second sheet of paper decreases when the paper feed start timing is advanced, the reference sheet interval time may be shortened by the amount T2−R2 as an exceptional case when correcting the paper feed start timing between the second sheet of paper and the sheet of paper following the second sheet of paper (the original reference sheet interval time is restored for the sheet of paper following the second sheet of paper and the sheet of paper following the sheet of paper following the second sheet of paper).

When, on the other hand, the sheet interval between the first sheet of paper and the second sheet of paper is equal to or less than the ideal sheet interval ($T2-R2 \leq 0$; i.e., $T2 \leq R2$), the engine control part 9 decides not to correct the paper feed start timing (or that the timing cannot be corrected). As a result of the engine control part 9 setting this specific correction, the engine control part 9 causes the paper feeding roller 22 to feed the sheet of paper following the second sheet of paper at the same paper feed start timing as for the second sheet of paper.

Next, cases of correction when the arrival of the second sheet of paper is delayed (i.e., $T1-R1>0$) will be described. (1) in FIG. 5 is a case in which the arrival of the second sheet of paper is delayed ($T1-R1>0$), and the sheet interval time T2 between the first sheet of paper and the second sheet of paper is longer than the reference sheet interval time R2 ($T2-R2>0$). In this case, the paper interval with the preceding sheet of paper has increased, and the measurement time T1 of the second sheet of paper is delayed with respect to the reference time. For this reason, the second sheet of paper can be described as being delayed. Thus, the paper feed start timing of the sheet of paper following the second sheet of paper is advanced by the amount $T2-R2$. Delays in the paper arriving at the resist roller pair 5 are thus eliminated from the very start of paper feeding. When the paper feed start timing is directly advanced by the difference between the measurement time T1 of the second sheet of paper and the reference measurement time R1, the sheet interval for sheets of paper after the second may become too small. However, because the paper feed start timing is advanced by the amount $T2-R2$, the correction amount takes the sheet intervals between the sheets of paper into account. Thus, a constant sheet interval between the second sheet of paper and the sheet of paper following the second sheet of paper is ensured.

(2) in FIG. 5 is a case in which the arrival of the second sheet of paper is delayed ($T1-R1>0$), and the sheet interval time T2 between the first sheet of paper and the second sheet of paper is equal to or less than the reference sheet interval time R2 ($T2-R2 \leq 0$). In this case, when the arrival of the second sheet of paper at the resist roller pair 5 is delayed from the reference, the sheet interval between the first sheet of paper and the second sheet of paper would normally be expected to increase. However, when the sheet interval is small, advancing the paper feed start timing is not necessarily suitable correction. Thus, the paper feed start timing of the sheet of paper following the second sheet of paper is unchanged from that of the second sheet of paper.

[Cases in Which the Arrival of the Second Sheet of Paper is Advanced ($T1-R1 \leq 0$)]

The engine control part 9 performs a calculation according to formula (1) above, and when the results are $(T1-R1) \leq 0$ (when $T1 \leq R1$; i.e., formula 1 yields a negative value), the engine control part 9 identifies the second sheet of paper as having arrived at the resist roller pair 5 sooner than the reference. On the basis of the identification results for the second sheet of paper, it is decided whether correction of the paper feed start timing is necessary, and, if so, to what extent.

When the arrival of the second sheet of paper is advanced (when $T1-R1 \leq 0$), the engine control part 9 next performs calculations according to the following formulas (3) and (4).

$R1-T1$ (reference measurement time−actually measured measurement time; corresponding to a first value) (Formula 3)

In this case, (formula 3) yields 0 or a positive value.

$R2-T2$ (reference sheet interval time−actually measured sheet interval time; corresponding to a second value) (Formula 4)

When $(R1-T1) \leq (R2-T2)$ (i.e., when the sheet interval between the first sheet of paper and the second sheet of paper is equal to or less than the shift in the timing of the arrival of the second sheet of paper at the resist roller pair 5), the engine control part 9 causes the paper feeding roller 22 to perform paper feeding at the same paper feed start timing as for the second sheet of paper (i.e., does not correct the timing), in accordance with the correction to be performed set by the engine control part 9. Because $(R1-T1)$ is always a positive value here, $(R2-T2)$ is positive as well. As such, the sheet interval time T2 in this case is smaller than the reference sheet interval time R2.

On the other hand, when $(R1-T1)>(R2-T2)$ (i.e., the degree of shift of the sheet interval between the first sheet of paper and the second sheet of paper is less than the shift in the timing of the arrival of the second sheet of paper at the resist roller pair 5), the engine control part 9 sets different correction amounts for different cases.

Specifically, when $(R1-T1)>(R2-T2)$ and $R2 \geq T2$ ($R2-T2 \geq 0$ and the sheet interval time for the first sheet of paper and the second sheet of paper is the same or the sheet interval is smaller than the reference interval), the engine control part 9 causes the paper feeding roller 22 to feed paper at a paper feed start timing that is delayed from that of the second sheet of paper by the amount $(R1-T1)-(R2-T2)$.

When $(R1-T1)>(R2-T2)$ and $R2<T2$ (when $R2-T2<0$, the sheet interval time for the first sheet of paper and the second sheet of paper is greater than the reference sheet interval time, and the sheet interval is greater than the reference interval), the engine control part 9 causes the paper feeding roller 22 to feed paper at a paper feed start timing that is delayed from that of the second sheet of paper by the amount $(R1-T1)+(R2-T2)$.

Next, cases of correction when the arrival of the second sheet of paper at the resist roller pair 5 is early (i.e., $T1-R1 \leq 0$) will be described. (3) in FIG. 5 is a case in which the arrival of the second sheet of paper at the resist roller pair 5 is advanced (i.e., $T1-R1 \leq 0$), and $(R1-T1) \leq (R2-T2)$. In this case, the sheet interval between the first sheet of paper and the second sheet of paper is smaller than the shift in the timing of the arrival of the second sheet of paper at the resist roller pair 5. Because the sheet interval is smaller in this case, causes such as the position of the leading end of the second sheet of paper placed in the paper feeding part 2 being shifted toward the downstream side of the paper conveyance direction can be presumed. Thus, the paper feed start timing of the sheet of paper following the second sheet of paper is unchanged from that of the second sheet of paper.

(4) in FIG. 5 is a case in which the arrival of the second sheet of paper at the resist roller pair 5 is advanced (i.e., $T1-R1 \leq 0$), $(R1-T1)$ is greater than $(R2-T2)$, and the reference sheet interval time R2 is equal to or longer than the sheet interval time T2 for the first sheet of paper and the second sheet of paper ($R2 \geq T2$). In this case, the sheet interval with the preceding sheet of paper is small ($R2 \geq T2$). The measurement time T1 of the second sheet of paper is also advanced with respect to the reference time. Thus, it is likely that the second sheet of paper is arriving at the resist roller pair 5 early (i.e., the paper feed start timing is too soon).

Thus, the paper feed start timing for the sheet of paper following the second sheet of paper is delayed from that for the second sheet of paper by the amount $(R1-T1)-(R2-T2)$, and the paper arrives at the resist roller pair 5 at a suitable timing. When the paper feed start timing is directly delayed by the difference between the measurement time T1 for the second sheet of paper and the reference measurement time R1, the sheet interval between the second sheet of paper and the sheet of paper following the second sheet of paper may be too great, or the amount of correction may otherwise be too much. However, because the correction amount is reduced from the difference between the measurement time T1 of the second sheet of paper and the reference measurement time R1 by the difference between R2−T2, i.e., (R1−T1; positive value)−(R2−T2; positive value), the correction amount takes the sheet interval between the sheets of paper into account, and the sheet interval between the second sheet of paper and the sheet of paper following the second sheet of paper does not become too great.

In FIG. 5, (5) is a case in which the arrival of the second sheet of paper at the resist roller pair 5 is advanced (i.e., T1−R1≤0), (R1−T1) is greater than (R2−T2), and the sheet interval time T2 for the first sheet of paper and the second sheet of paper is longer than the reference sheet interval time R2 (T2>R2). In this case, the paper interval with the preceding sheet of paper has increased (T2>R2), and the measurement time T1 of the second sheet of paper is advanced with respect to the reference time. As such, it can be assumed that the paper feed start timing for the sheet of paper following the second sheet of paper can be delayed without issue. Thus, the paper feed start timing for the sheet of paper following the second sheet of paper is delayed from that for the second sheet of paper by the amount (R1−T1)+(T2−R2). The paper is thus made to arrive at the resist roller pair 5 at a suitable timing.

In some cases, there may be no advance or delay in conveying the paper even though the time necessary to convey the paper P from one point to another (in the present embodiment, from when the paper feed start signal is given to when the resist sensor S1 detects the arrival of the paper) is advanced or delayed with respect to a reference time. Thus, in the image forming apparatus (printer 100) according to the present embodiment, the sheet interval is considered in deciding whether correction is needed, and, if so, to what extent. It is thereby possible to rigorously identify advances or delays in paper conveyance. As a result, the paper feed start timing of the paper feeding part 2 is rigorously corrected. Even in the case of an image forming apparatus in which the intermediate roller pair 4 is not stopped and the amount of curl in the paper P is corrected only using the resist roller pair 5, the paper P is made to arrive at the resist roller pair 5 at a suitable timing, and the amount of curl in the paper P is constant. Stable paper conveyance is thus achieved.

Conventionally, the intermediate roller pair 4 is temporarily stopped, and the amount of curl in the paper P at the resist roller pair 5 adjusted. However, deviations in the response speed on the electromagnetic intermediate roller clutch 41 in coupling and releasing, individual differences, or degradation from aging can lead to variations in the amount of curl in the paper P. Thus, in the printer 100 according to the present embodiment, while the paper is being conveyed (until one printing job is finished), the engine control part 9 continues to rotate the intermediate roller pair 4 (signal sent to the electromagnetic intermediate roller clutch 41 kept at high), as described above.

However, if the paper feed start timing is too soon, the sheet interval may become small enough that the time necessary for the minimum necessary sheet interval (hereafter referred to as "necessary sheet interval time Pt") downstream of the resist roller pair 5 cannot be ensured. A sheet interval that is too small can cause a paper jam. A sheet interval that is too small can also prevent the toner image from being transferred to the appropriate position on the paper. Cases where the second sheet of paper arrives too soon (T1−R1≤0) can arise from the paper feed start timing being too soon. Thus, the engine control part 9 may be configured so as to delay the paper feed start timing only in a case where the second sheet of paper has arrived early (T1−R1≤0) and the sheet interval time T2 is shorter than the necessary sheet interval time Pt.

Data indicating the necessary sheet interval time Pt is stored, for example, in the memory 92 of the engine control part 9. When the second sheet of paper arrives early (T1−R1≤0), the engine control part 9 confirms whether the sheet interval is shorter than the minimum sheet interval (time) necessary downstream of the resist roller pair 5 (i.e., the sheet interval time is too short) on the basis of whether or not the sheet interval time T2 is shorter than the necessary sheet interval time Pt. The engine control part 9 then delays the paper feed start timing only in a case where the sheet interval time T2 is shorter than the necessary sheet interval time Pt.

(Process of Correcting Paper Feed Start Timing)

Figure 6:
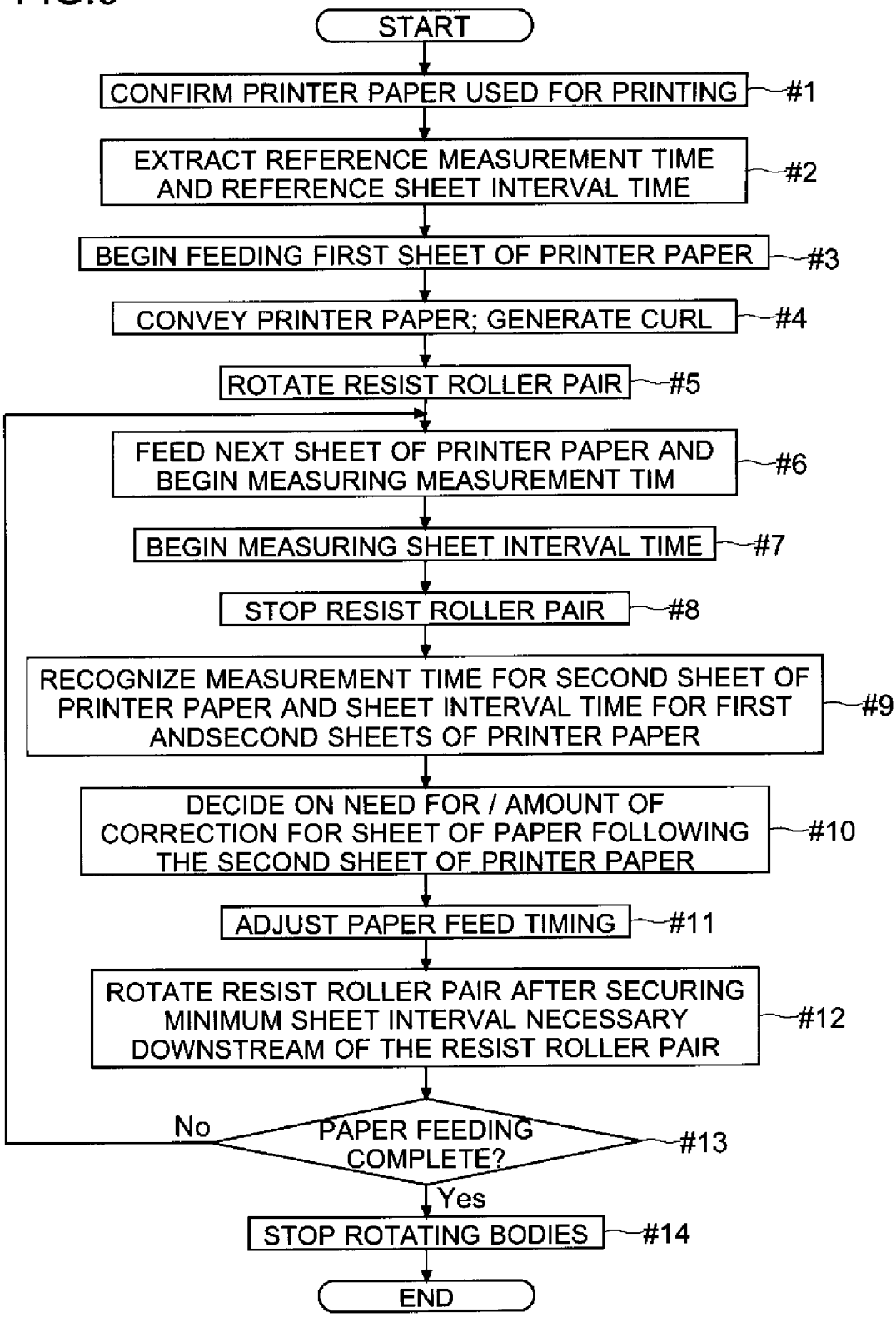
FIG. 6 is a flow chart illustrating an example of a procedure of correcting paper feed start timing in the printer according to the first embodiment.

Next, an example of a process of correcting paper feed start timing in the printer 100 according to the first embodiment will be described with reference to FIG. 6 and FIG. 7. FIG. 6 is a flow chart illustrating an example of a procedure of correcting paper feed start timing in the printer 100 according to the first embodiment. FIG. 7 is an illustration of an example of data used to correct paper feed start timing in the printer 100 according to the first embodiment.

First, when correcting paper feed start timing according to the present embodiment, the necessity and extent of correction is identified by looking at the sheet interval time T2. Thus, START in FIG. 6 is the start of a print job in which two or more sheets of paper P are continuously conveyed. In other words, START is the point in time when image data of two or more pages is received from the computer 200 as data to be used in printing, and the print job starts.

When the print job starts, the engine control part 9 confirms the paper P being used for printing (step #1). In other words, the engine control part 9 confirms what kind of paper P is being used for printing.

Specifically, the engine control part 9 confirms the thickness and type of paper being used for printing. The stiffness of the paper can vary, for example, according to the thickness of the paper; a stiff paper stock such as heavy stock can rub strongly against the guide in the conveyance part 3, reducing conveyance speed. When this happens, the length of time from when the paper feed start signal is given to when the resist sensor S1 detects the arrival of the paper is longer, for example, than for regular or lightweight stock. The load required for the rotation of the conveying member and the degree of slippage also vary according to the thickness and surface finish of the paper. For example, a paper P with a coated surface (for example, glossy stock) may not slip as readily as uncoated ordinary paper (regular stock). In this way, the time from when the paper feed start signal is given to when the resist sensor S1 detects the arrival of the paper differs according to paper type, and the sheet interval time T2 may also differ.

Thus, paper feed start timing correction data for which a reference measurement time and a reference sheet interval time are decided according to the thickness and surface of the paper is stored in the memory 92. FIG. 7 is a conceptual illustration of the paper feed start timing correction data. As shown in FIG. 7, the reference measurement time and reference sheet interval time are decided according to, for example, paper thickness.

Paper thickness may be indicated in terms of grammage ($g/m^2$), but the thicknesses of paper treated as regular stock, heavy stock, and light stock, as well as the reference measurement time and reference sheet interval time for regular stock, heavy stock, and light stock, may be chosen as desired. For example, regular stock, heavy stock, and light stock recommended by the manufacturer of the printer 100 (the applicant) may be measured to decide upon the reference measurement time and the reference sheet interval time. Alternatively, statistical data for regular stock, heavy stock, and light stock in general distribution may be used to find the average thicknesses for regular stock, heavy stock, and light stock, and the reference measurement time and reference sheet interval time can be decided upon on the basis of these averages. The same applies for coated paper, and coated paper recommended by the manufacturer of the printer 100 (the applicant) may be used, or statistical data may be used to find the average coated paper thickness and decide upon the reference measurement time and reference sheet interval time.

The reference measurement time and reference sheet interval time may also differ according to the size of the paper. Therefore, as represented in FIG. 7, the reference measurement time and reference sheet interval time may also be decided upon according to the paper type for each paper size.

Settings for the type and size of paper used for printing can be inputted into the operating panel 1. The paper type and size settings inputted using the operating panel 1 are sent to the engine control part 9 via the control part 8. The engine control part 9 is capable of recognizing the type and size of paper used for printing. The computer 200 to which the image data is sent is installed with printer driver software for using the printer 100. The printer driver software may also be configured so as to allow the type and size of paper used in printing to be set. The set paper type and size may also be sent to the printer 100 (I/F part 84) as settings data. In other words, the engine control part 9 may also recognize or confirm the type and size of the paper on the basis of the printing-related settings data sent from the computer 200.

Next, the engine control part 9 refers to the paper feed start timing data stored in the memory 92, and extracts the reference measurement time and reference sheet interval time to be used for correcting the paper feed start timing according to the type (thickness, etc.) of paper (step #2).

Next, the engine control part 9 issues a signal indicating to start paper feeding, and the first sheet of paper P is fed (step #3). The engine control part 9 then rotates the intermediate roller pair 4, causing the paper to be conveyed towards the resist roller pair 5 and curl to be generated (step #4). The engine control part 9 then rotates the resist roller pair 5 after the curl generation time W1 has passed (step #5).

Next, the engine control part 9 issues a signal indicating to begin feeding the next sheet of paper P (the second sheet of paper), and the next sheet of paper P is fed and measurement of the measurement time T1 begins (step #6). As the following end of the sheet of paper P (the first sheet of paper) sent out from the resist roller pair 5 passes by, the engine control part 9 begins measuring the sheet interval time T2 (step #7). The engine control part 9 then stops the resist roller pair 5 until the next sheet of paper P (the second sheet of paper) arrives (step #8). Finally, the engine control part 9 recognizes the measurement time T1 for the paper P (the second sheet of paper) arriving at the resist sensor S1 and the sheet interval time T2 for the sheet of paper P (the first sheet of paper) conveyed immediately beforehand and the second sheet of paper arriving at the resist sensor S1 from the paper P arriving at the resist sensor S1 (step #9).

The engine control part 9 then decides on the basis of the formulas given above whether there is a need to correct the paper feed start timing for the sheet of paper following the second sheet of paper, whether to advance or delay the paper feed start timing, and the amount by which the paper feed start timing is corrected (specific correction) when correction is performed (step #10). On the basis of the correction to be performed, the engine control part 9 then advances or delays the paper feed start timing for the paper P fed after the second sheet of paper, correcting (adjusting) the paper feed start timing (step #11). In other words, the engine control part 9 advances or delays the timing at which the paper feeding roller 22 begins to rotate from the present timing. If it has been decided that correction will not be performed, the paper feed start timing is not corrected.

The amount by which the engine control part 9 advances or delays the paper feed start timing from that of the second sheet of paper may be even smaller than the found (decided) correction amount. The position of the leading end of the paper P placed in the paper feeding part 2 may shift downstream in the paper conveyance direction. Shifting downstream in the paper conveyance direction may occur when, for example, an overlapped sheet of paper P is sent back in the direction of the paper feeding part 2 at the pickup part 31, or when paper P is dragged in the direction of the pickup part 31 during paper feeding due to friction from the paper P.

When the position of the leading end of the paper P placed on the paper feeding part 2 is shifted downstream in the paper conveyance direction, the paper P arrives at the resist roller pair 5 early. When, for example, the time needed to convey the paper from the paper feeding roller 22 to the pickup part 31 is approximately 100 ms, the difference with the measurement time T1 will be approximately from 0 to 100 ms. Thus, the sheet interval may become too small when the timing is corrected by the decided-upon correction amount.

Thus, the correction of the paper feed start timing in step #11 may be within a range smaller than the decided-upon correction amount. Moreover, when correcting the paper feed start timing, even in a case where the engine control part 9 has decided to advance the paper feed start timing, it is acceptable to correct the paper feed start timing only to the minimum extent necessary to obtain the needed sheet interval between sheets of paper.

When three or more sheets of paper are continuously conveyed, the paper feed start timing is corrected when feeding the third sheet and afterwards. Advancing the paper feed start timing may possibly decrease the sheet interval. In the loop shown in the present flow chart, for example, when correction advancing the paper feed start timing is performed a plurality of time, the sheet interval may become smaller.

When this happens, it is possible that, after the arrival of the paper at the resist sensor S1 is detected, the printer waits for the curl generation time W1 while continuing to rotate the intermediate roller pair 4, and the resist roller pair 5 begins rotating immediately thereafter, securing the minimum necessary sheet interval downstream of the resist roller pair 5 (at the image-forming part 6, fuser part 7*a*, and the like) may not be possible. When, for example, the minimum necessary sheet interval cannot be secured, the toner image will not be formed in time, and the transfer position of the toner image on the paper P will be shifted. The following sheet of paper P may also collide with the preceding sheet of paper P, causing a paper jam.

Thus, for example, when (sheet interval time T2−curl generation time W1) is less than Pt (Pt being the minimum necessary sheet interval time downstream of the resist roller pair 5), the engine control part 9 uses the electromagnetic intermediate roller clutch 41 to temporarily stop the intermediate roller pair 4. Then, after waiting for a time equal to Pt−(sheet interval time T2−curl generation time W1) after the intermediate roller pair 4 has been stopped, the engine control part 9 rotates the resist roller pair 5 and the intermediate roller pair 4.

After ensuring the minimum necessary sheet interval downstream of the resist roller pair 5 in this way, the engine control part 9 rotates the resist roller pair 5 and sends out the paper P after the latter has reached the resist roller pair 5 and curl is generated therein (step #12). This is made possible by measuring the sheet interval.

It is also possible to stop the intermediate roller pair 4 and secure the minimum necessary sheet interval downstream from the resist roller pair 5. However, when continuously printing, the engine control part 9 may also delay the paper feed start timing and secure the minimum necessary sheet interval downstream from the resist roller pair 5 without stopping the intermediate roller pair 4 only in cases when the second sheet of paper is arriving early (i.e., T1−R1≤0), and the sheet interval time T2 is shorter than the necessary sheet interval time Pt, as described above.

Next, the engine control part 9 confirms whether all the sheets of paper P needing to be fed have been fed (step #13). If all sheets have been fed (step #13=Yes), the engine control part 9 stops the conveyor motor 34 once paper conveyance and image formation are complete, stopping the various rotating bodies such as the paper feeding roller 22, intermediate roller pair 4, resist roller pair 5, and the like (step #14). This completes the control process (END).

If all sheets have not been fed (step #13=No), the process returns to step #6. In this way, the measurement time T1 and sheet interval time T2 are measured for the second and successive sheets of paper P, and the paper feed start timing for the next sheet of paper P arriving at the resist roller pair 5 after a sheet of paper P is corrected according to the feedback thus received.

(Paper Conveyance Delay Alert)

Next, a paper conveyance delay alert of the printer 100 according to the first embodiment will be described.

As described above, the paper feed start timing is corrected so that the arrival of the paper P is neither delayed nor advanced with respect to the timing at which the resist roller pair 5 begins rotating. However, if the intermediate roller pair 4, paper feeding roller 22, or the like are worn beyond their lifespan or are not properly cleaned, the arrival of the paper P at the resist roller pair 5 will tend to be delayed no matter how many times the paper feed start timing is corrected.

Thus, the engine control part 9 counts the number of sheets printed per unit of time and confirms whether or not a predetermined reference number of sheets printed per unit of time has been secured. The reference number of printed sheets is decided upon in the specifications, and is often decided in the form of pages per minute (ppm), such as, for example, 30 A4 size (may also be letter size; likewise hereafter) sheets per minute, 40 A4 size sheets per minute, 60 A4 size sheets per minute, and so on.

The (timer part 93 of the) engine control part 9 measures, for example, the time from when feeding of the first sheet of paper begins until the last sheet of paper P for the print job is ejected using an discharge detecting sensor S2 (cf. FIG. 1) provided in the vicinity of the ejector roller pair 76. The engine control part 9 divides, for example, the total number of printed sheets for the job by (time needed for printing [seconds]/60 [seconds]) to find the number of sheets printed per minute.

The discharge detecting sensor S2 is an optical sensor for detecting the arrival and passage of the paper P. The output from the discharge detecting sensor S2 is inputted into the engine control part 9, and the engine control part 9 confirms paper discharge.

When the number of sheets printed per unit of time is less than the reference number of printed sheets even after the paper feed start timing has been advanced a predetermined number of times, correcting the paper feed start timing will not enable productivity to be maintained. There is also the possibility of a problem being present in the intermediate roller pair 4 or paper feeding roller 22. Thus, when the number of sheets printed per unit of time is less than the reference number of printed sheets even though the paper feed start timing has been advanced a predetermined number of times, the engine control part 9 uses the LCD 11 or indicator 13 of the operating panel 1 to issue an alert urging the user to check the intermediate roller pair 4 or paper feeding roller 22.

For example, the engine control part 9 displays text or an error code on the LCD 11 urging the user to check the intermediate roller pair 4 or paper feeding roller 22. Alternatively, the engine control part 9 lights and turns off the indicator 13, issuing an alert using flashing light to urge the user to check the intermediate roller pair 4 or paper feeding roller 22.

(Second Embodiment)

Figure 8:
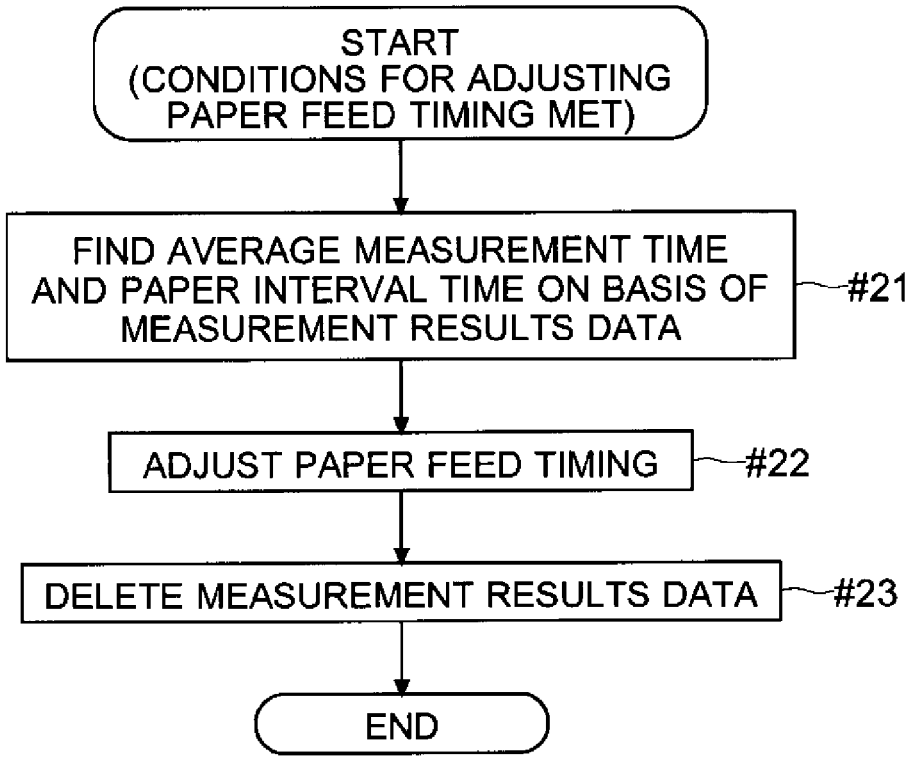
FIG. 8 is a flow chart illustrating an example of a procedure of correcting paper feed start timing in a printer according to a second embodiment.

Next, a process of correcting paper feed start timing in an image forming apparatus (printer 100) according to a second embodiment will be described with reference to FIG. 8. FIG. 8 is a flow chart illustrating an example of a procedure of correcting paper feed start timing in the printer 100 according to the second embodiment.

When actually using the printer 100, spontaneous paper conveyance delays may occur. Correcting the paper feed start timing as described in the first embodiment allows spontaneous paper conveyance delays to be handled. However, delays in paper conveyance (delayed arrival at the resist roller pair 5) also tend to occur as the result of wear or the like in the paper feeding roller 22 or intermediate roller pair 4. In such cases, the paper feed start timing must be corrected in order to order meet the number of sheets printed per unit of time (e.g., ppm) called for in the specifications or design at all times.

In the first embodiment, the paper feed start timing was corrected every time measurement time T1 and sheet interval time T2 was measured, but, from considerations of reducing the processing load of the engine control part 9 and dealing with aging-related paper conveyance delays, it may be sufficient to print a plurality of sheets of paper P, find the average measurement time T1 and sheet interval time T2 for the plurality of sheets of paper P at the resist roller pair 5, and correct the paper feed start timing on the basis of the averages.

Thus, in the first embodiment, the measurement time T1 and sheet interval time T2 were measured for each sheet during continuous paper conveyance, and the paper feed start timing was corrected every time the sheet interval time T2. However, in the second embodiment, a plurality of sheets of paper P is printed, the averages of the measurement time T1 and sheet interval time T2 are found at a predetermined point in time, and the paper feed start timing is corrected. The second embodiment differs from the first embodiment in the point in time at which the paper feed start timing is corrected. However, the configuration of the printer 100 and the basic philosophy underlying paper feed start timing correction may be the same as in the first embodiment. Therefore, the description of the first embodiment can be cited for points common to the first embodiment and the second embodiment; as such, description and illustration of any common points will be omitted, except when special descriptions are made.

The memory 92 (or storage device 83) stores, for example, measurement results data for finding the averages of the measurement time T1 and the sheet interval time T2. The memory 92 also stores, for example, multiple sheets' worth of measurement results data for the measurement time T1 for the second sheet of paper and the sheet interval time T2 for the first sheet of paper and the second sheet of paper. When the paper feed start timing is corrected, the engine control part 9 finds the averages for the measurement time T1 and the sheet interval time T2 on the basis of the measurement time T1 and sheet interval time T2 for each sheet of the paper P.

Alternatively, the engine control part 9 finds the averages for the measurement time T1 and the sheet interval time T2 every time the measurement time T1 for the second sheet of paper and the sheet interval time T2 for the first sheet of paper and the second sheet of paper are measured. The memory 92 then stores the averages for the measurement time T1 and the sheet interval time T2 for several pages' worth of each type and size of paper P as measurement results data.

The point in time at which the paper feed start timing is corrected can be decided upon as desired. For example, the paper feed start timing may be corrected every time a predetermined number of sheets has been printed. The predetermined number of sheets may be decided upon as desired (for example, 10 sheets, 500 sheets, 1,000 sheets, and so on), as long as the number of sheets allowing tendencies toward paper conveyance delays or advances to be detected.

Alternatively, the point in time when the paper feed start timing is corrected may be the point in time when the cassette 21 is removed from the paper feeding part 2 for refilling the paper. When the paper in the cassette 21 runs out, the user removes the cassette 21 in order to refill it with paper. A bundle of, for example, approximately 500 sheets of regular stock can be set in the cassette 21. In general, regular stock is often packaged in units of 500 sheets.

Therefore, the cassette 21 being removed means that approximately 500 sheets have been printed. The engine control part 9 recognizes whether the cassette 21 has been inserted or removed. The engine control part 9 may also correct the paper feed start timing after a predetermined number of sheets has been printed.

Specifically, for example, an insertion/removal detection sensor S3 (for example, an interlock switch; equivalent to an insertion/removal detector; cf. FIG. 1) for detecting when the cassette 21 is removed or installed is connected to the engine control part 9 in order to recognize when the cassette 21 has been removed or installed. The output of the insertion/removal detection sensor S3 (for example, high and low) differs depending on whether the cassette 21 has been removed or installed. The output from the insertion/removal detection sensor S3 is inputted to, for example, the engine control part 9 (cf. FIG. 2). The engine control part 9 is thereby capable of recognizing whether the cassette 21 has been removed or installed (inserted/removed).

As a general tendency, paper jams are liable to occur when the conveyance of the paper is delayed. Thus, the engine control part 9 may also correct the paper feed start timing when a paper jam (clogging caused by paper) has occurred. The point in time when the paper feed start timing is corrected can be the point in time while the paper is being conveyed when the paper jam occurs. Paper jams can also occur as a result of the paper feed start timing (when the sheet interval is too small, or under other circumstances). Therefore, the engine control part 9 may correct the paper feed start timing when a paper jam occurs.

Specifically, paper jam detection is performed by, e.g., the engine control part 9. The conveyance part is provided with a sensor (hereafter referred to as the "paper sensor") for detecting the arrival and passage of paper. Examples of usable paper sensors include, for example, the resist sensor S1, the discharge detecting sensor S2, or a paper feeding sensor S4 to be described below (cf. FIG. 2). Alternatively, the fuser part 7*a* may be provided with a paper sensor (fuser sensor S5; cf. FIG. 1).

When, for example, the arrival or passage of the paper cannot be detected at each of the paper sensors (the resist sensor S1, discharge detecting sensor S2, paper feeding sensor S4, and fuser sensor S5; corresponding to paper jam detection parts) within a predetermined acceptable time within which the arrival of the paper should be detected or respective predetermined acceptable times within which the arrival of the paper should be detected after the paper feed start signal has been issued, the engine control part 9 recognizes a paper jam as having occurred. The engine controller also recognizes a paper jam as having occurred when, after the resist roller pair 5 is rotated, the paper cannot be detected passing the resist sensor S1 within a predetermined acceptable time needed for the paper P to pass.

Next, a process of correcting paper feed start timing in the second embodiment will be described with reference to FIG. 8. START in FIG. 8 is a point in time when predetermined conditions for correcting the paper feed start timing have been met. For example, let it be a condition that one or more of a predetermined number of sheets be printed after use of the printer 100 has begun or after the paper feed start timing has first been corrected, the cassette 21 be inserted/removed, or a paper jam occur , as described above.

When the conditions for correcting the paper feed start timing have been met, the engine control part 9 finds the averages for the measurement time T1 and the sheet interval time T2 on the basis of the measurement results data (step #21). The engine control part 9 finds the averages from use of the printer 100 has begun or after the paper feed start timing has first been corrected to now (when this process is carried out). The engine control part 9 then decides on the basis of the average times whether there is a need for correction, whether to advance or delay the paper feed start timing, and the amount by which the paper feed start timing is corrected (specific correction) when correction is performed, as in the case of the first embodiment, and corrects the paper feed start timing (step #22). The engine control part 9 then deletes the measurement results data in the memory 92 (step #23), and the control process finishes. A configuration in which the measurement results data in the memory 92 is not deleted is also acceptable.

The size or type of the paper accommodated in the paper feeding part 2 may be changed. The memory 92 may therefore store the measurement time T1 and sheet interval time T2 for multiple pages' worth of the size or type of paper currently accommodated in the paper feeding part 2. The paper feed start timing may then be corrected using the reference measurement time, reference sheet interval time, and averages for the size or type of paper accommodated in the paper feeding part 2 at a predetermined point in time for correcting the paper feed start timing.

Thus, the image forming apparatus (printer 100) of the first and second embodiment includes an image-forming part 6 for forming an image upon paper P; a resist part (the resist roller pair 5) for conveying paper P towards the image-forming part 6; a paper feeding part 2 accommodating a plurality of sheets of paper P and having a paper feeding rotating body (the paper feeding roller 22), the paper feeding rotating body being rotated so as to send paper P out towards the resist part; a detector (the resist sensor S1) for detecting the arrival of paper at the resist part, the detector being provided upstream of the resist part in the paper conveyance direction; a timer part 93 for measuring a measurement time T1 from when feeding of a second sheet of paper from the paper feeding part 2 is begun to when the detector detects the arrival of the second sheet of paper, and a sheet interval time T2 from when the detector detects the passage of a first sheet of paper P immediately preceding the second sheet of paper to when the arrival of the second sheet of paper is detected; and an identifier part (the engine control part 9) for referring to the measurement time T1 and a predetermined reference measurement time R1 acting as a reference for the measurement time T1, referring to the sheet interval time T2 and a predetermined reference sheet interval time R2 acting as a reference for the sheet interval time T2, and deciding upon the correction to be performed upon the paper feed start timing; the paper feeding part 2 advancing or delaying the paper feed start timing with respect to the current paper feed start timing on the basis of the correction to be performed decided upon by the identifier part.

It is thereby possible to correct the paper feed start timing on the basis of a comprehensive, accurate assessment of any delay or advance in paper conveyance speed while taking the sheet interval between one sheet of paper and the next into account. The reference measurement time R1 is a predetermined ideal measurement time T1 when there are no delays or advances. The reference measurement time R1 is, for example, the time obtained by dividing the distance between two points between which conveyance time is measured by a predetermined paper conveyance speed in the design or specifications of the image forming apparatus (printer 100). The reference sheet interval time R2 is the time for a predetermined ideal sheet interval when there are no delays or advances. For example, the reference sheet interval time R2 is the time obtained by dividing a predetermined distance (interval) between two sheets of paper P in the design or specifications of the image forming device (printer 100) by the predetermined paper conveyance speed.

When the difference between measurement time T1 or average of the measurement time T1 and reference measurement time R1 is a value greater than zero (i.e., when the arrival of the second sheet of paper is delayed), the identifier part (engine control part 9) decides to perform correction by advancing the paper feed start timing with respect to the current paper feed start timing by an amount of time equal to the sheet interval time T2 or average of the sheet interval time T2 less the reference sheet interval time R2 when the sheet interval time T2 or average of the sheet interval time T2 is longer than the reference sheet interval time R2 (i.e., when it is clear from the sheet interval that the second sheet of paper is delayed with respect to the first sheet of paper), and decides not to perform correction when the sheet interval time T2 or average of the sheet interval time T2 is equal to or less than the reference sheet interval time R2 (i.e., when the arrival of the second sheet of paper is delayed, but the sheet interval between the first sheet of paper and the second sheet of paper is small). It is thereby possible to accurately assess the need for correction of the paper feed start timing occurring along with paper conveyance delays while taking the sheet interval into account.

Specifically, when a delay in the arrival of the second sheet of paper is observed (measurement time T1 or average of the measurement time T1−reference measurement time R1>0), and the sheet interval between the first sheet of paper and the second sheet of paper is greater than the reference interval (sheet interval time T2 or average of the sheet interval time T2−reference sheet interval time R2>0), the second sheet of paper is considered to be delayed, and correction is performed by advancing the paper feed start timing. On the other hand, when the sheet interval between the first sheet of paper and the second sheet of paper is equal to or less than the standard interval (for narrow sheet intervals, sheet interval time T2 or average of the sheet interval time T2−reference sheet interval time R2≤0), no correction is performed. When the second sheet of paper is delayed, the sheet interval between the first sheet of paper and the second sheet of paper would normally be expected to increase, but when the sheet interval is small, advancing the paper feed start timing is not necessarily suitable correction (for example, correcting the paper feed start timing might make the sheet interval between the second sheet of paper and the sheet of paper P following the second sheet of paper overly small). Thus, when the sheet interval time T2 or average of the sheet interval time T2 is equal to or less than the reference sheet interval time R2, it is decided to perform no correction at all. When correction is performed simply by advancing the paper feed start timing by the amount of deviation between the measurement time T1 or average of the measurement time T1 and the reference measurement time R1, the sheet interval may become too small, but because the paper feeding part 2 corrects the paper feed start timing on the basis of the time equating to the sheet interval time T2 or average of the sheet interval time T2 less the reference sheet interval time R2 (i.e., on the basis of the sheet interval), it is possible to prevent the sheet interval from becoming too small.

When the difference between measurement time T1 or average of the measurement time T1 and reference measurement time R1 is a value equal to or less than zero (i.e., the arrival of the second sheet of paper at the resist part (the resist roller pair 5) is not delayed or is advanced), the identifier part (engine control part 9) finds a first value obtained by subtracting measurement time Ti or average of the measurement time Ti from reference measurement time R1 (reference measurement time R1−measurement time T1 or average of the measurement time T1) and a second value obtained by subtracting sheet interval time T2 or average of the sheet interval time T2 from reference sheet interval time R2 (reference sheet interval time R2−sheet interval time T2 or average of the sheet interval time T2), decides not to perform correction when the second value is equal to or greater than the first value (i.e., when the sheet interval between the first sheet of paper and the second sheet of paper is smaller than the shift in the timing of the arrival of the second sheet of paper at the resist part), and decides to delay the paper feed start timing with respect to the current paper feed start timing when the first value is greater than the second value (i.e., when the shift in the sheet interval between the first sheet of paper and the second sheet of paper is smaller than the shift in the timing of the arrival of the second sheet of paper at the resist part). It is thereby possible to accurately assess the need for correction of the paper feed start timing occurring along with paper conveyance advances while taking the sheet interval into account.

Specifically, when an advance in the arrival of the second sheet of paper is observed (measurement time T1 or average of the measurement time T1−reference measurement time R1≤0), and the second value is equal to or greater than the first value (first value≤second value), the sheet interval between the first sheet of paper and the second sheet of paper is likely to be quite small. Such large advances of the second sheet of paper are thought to be caused by feeding of the second sheet of paper being begun with the position of the leading end of the paper P in the paper feeding part 2 deviating towards the downstream side of the paper conveyance direction, and correction thereof is better avoided. Thus, correction is not performed when the second value is equal to or greater than the first value (first value≤second value). On the other hand, when the second value is smaller than the first value (first value>second value), the shift in the sheet interval is smaller than the shift in the arrival of the second sheet of paper with respect to the reference, and thus correction is performed by delaying the paper feed start timing.

The paper P supplied from the paper feeding part 2 is conveyed towards the resist part (resist roller pair 5), with there being a rotating body (the intermediate roller pair 4) that continues to rotate while a plurality of sheets of paper P is being conveyed; when the measured sheet interval time T2 is shorter than the sheet interval necessary downstream of the resist part in the paper conveyance direction, the rotating body temporarily stops rotating, and the rotating body and resist part begin conveying the paper after waiting until the necessary sheet interval is reached.

It is thereby possible to appropriately time the arrival of the paper P at the resist part with the generation of curl in the paper P and the resist part (resist roller pair 5) sending out the paper P, even in the case of an image forming apparatus (printer 100) in which the intermediate roller is not stopped while continuous paper conveyance is performed. When the paper P is delayed due, for example, to degradation of the rollers caused by aging, the paper feed start timing is advanced and the productivity (ppm) of the image forming apparatus (printer 100) is ensured. As a result, the paper P has a constant amount of curl, and no jams or printing delays arise, allowing the desired conveyance performance to be attained. Advancing the paper feed start timing may decrease the sheet interval. In such cases, when the resist part (resist roller pair 5) conveys the paper immediately after waiting for the curl generation time once the detector (resist sensor S1) has detected the arrival of the paper, the paper P may be sent out at intervals shorter than the sheet interval necessary downstream of the resist part. When this happens, problems such as image formation not being on time, shifts in the position at which the image is formed on the paper P, or paper P jams can occur. However, the rotating body (intermediate roller pair 4) temporarily stops rotating, and the rotating body resist part waits until the necessary sheet interval is reached before starting to convey the paper P. It is thereby possible to make use of measuring the sheet interval to send out the paper P with the sheet interval necessary downstream of the resist part in the paper conveyance direction having been secured.

The identifier part (engine control part 9) delays the paper feed start timing with respect to the current paper feed start timing only when the sheet interval time T2 is shorter than the sheet interval necessary downstream of the resist part (resist roller pair 5) in the paper conveyance direction. It is thereby possible to delay the paper feed timing only when the paper feed start timing is too advanced and the minimum necessary sheet interval cannot be ensured, while not delaying the paper feed start timing so that the number of sheets printed per unit of time does not decrease when the minimum necessary sheet interval has been ensured.

The identifier part (engine control part 9) is configured so as to decide upon the correction to be performed every time the sheet interval time T2 is measured, and the paper feeding part 2 is configured so as to advance or delay the paper feed start timing every time the identifier part decides upon the correction to be performed. The paper feeding part 2 thus uses feedback to correct the paper feed start timing when paper P is continuously conveyed. It is thereby possible to cause the paper P to arrive at the resist part (resist roller pair 5) at a suitable timing.

A drive controller (the engine control part 9) for issuing a paper feed start signal directing the paper feeding rotating body (paper feeding roller 22) to start rotating is also included, and the timer part 93 measures the time from when the paper feed start signal is issued to when the detector (resist sensor S1) detects the arrival of the paper as measurement time T1, with the reference measurement time being a predetermined time acting as a reference for the time from when the paper feed direction signal is issued to when the detector (resist sensor S1) detects the arrival of the paper. The time from when the paper feed start signal (paper feeding ON signal) is issued to the paper feeding part 2 to when the detector detects the leading end of the paper is thereby measured as measurement time T1. It is thereby possible to correct the paper feed start timing on the basis of the time needed to convey the paper.

An input part (the operating panel 1 or I/F part 84) for accepting settings inputs for the thickness of the paper accommodated in the paper feeding part 2 and used for printing is also included, and the identifier part (engine control part 9) switches the reference measurement time and the sheet interval time T2 according to the inputted paper thickness setting. Differences in the degree of slippage and the load borne during paper conveyance lead to differences in paper conveyance speed depending on paper type (thickness or material). For example, the time needed to convey heavy stock will be longer than the time needed to convey regular office paper P, even if the members involved in conveying the paper are driven in the same manner. However, in accordance with the present configuration, the paper feed start timing can be corrected according to paper type.

A counter part (for example, the engine control part 9) for counting the number of sheets printed per unit of time and an alert-issuing part for issuing an alert (the LCD 11 or indicator 13) are also included, and when the number of sheets printed per unit of time counted by the counter part is less than a predetermined reference number of printed sheets acting as a reference for the number of sheets printed per unit of time even after the paper feeding part 2 has advanced the paper feed start timing a predetermined number of times, the alert-issuing part issues an alert urging the user to check one or more of the paper feeding part 2, the rotating body (intermediate roller pair 4), and the resist part (resist roller pair 5). When the arrival of the paper P at the resist part is delayed even after repeated correcting the paper feed start timing, there may be a malfunction in the members performing paper feeding or conveying, or the members may have worn down to an advanced degree. Thus, according to the present configuration, it is possible to notify the user of the need to inspect or check the conveyance-related members.

As the cumulative number of conveyed sheets increases, delays in paper conveyance tend to appear due to wear in the rotating body (intermediate roller pair 4). The image forming apparatus (printer 100) according the present embodiment thus includes a storage part (the memory 92 or storage device 83) for storing the measurement results data of the sheet interval time T2 and the measurement time T1 for multiple sheets' worth of paper, and the identifier part (engine control part 9) finds the average sheet interval time T2 and the average measurement time T1 for multiple sheets' worth of the paper at a predetermined time, and decides on the correction to be performed upon the paper feed start timing on the basis of the average sheet interval time T2 and average measurement time T1. It is thereby possible to correct (advance) the paper feed start timing in response to tendencies toward conveying delays in the image forming apparatus over time.

The paper feeding part 2 has a paper accommodating body for accommodating a plurality of sheets of paper P and an insertion/removal detector (the insertion/removal detection sensor S3) for detecting the insertion/removal of the paper accommodating body (cassette 21); and, when insertion or detection of the paper accommodating body is detected, the identifier part (engine control part 9) finds the average sheet interval time T2 and the average measurement time T1 for multiple sheets' worth of paper, and decides upon the correction to be performed upon the paper feed start timing on the basis of the average sheet interval time T2 and the average measurement time T1. It is thereby possible to correct the paper feed start timing in keeping with the timing at which the paper P is replenished after a constant number of sheets have been printed.

The image forming apparatus (for example, the printer 100) has a paper jam detection part (the resist sensor S1, discharge detecting sensor S2, paper feeding sensor S4, or fuser sensor S5) for detecting the occurrence of paper jams in the conveyance path, and, when a paper jam has been detected, the identifier part (engine control part 9) finds the average sheet interval time T2 and the average measurement time Ti for multiple sheets' worth of paper, and decides upon the correction to be performed upon the paper feed start timing on the basis of the average sheet interval time T2 and the average measurement time T1. It is thereby possible to correct the paper feed start timing so that paper P jams resulting from the paper feed start timing are eliminated.

(Third Embodiment)

Figure 9:
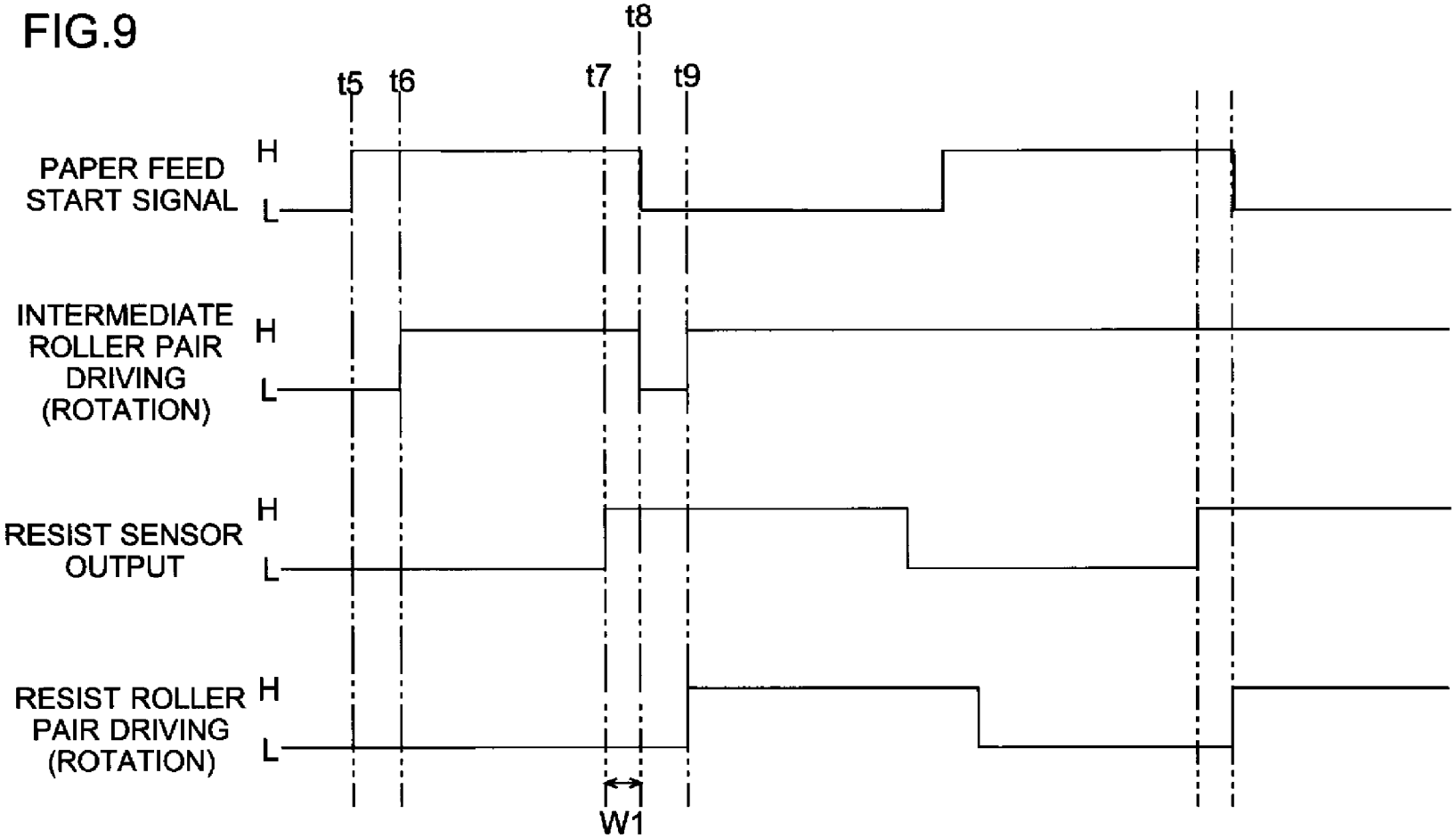
FIG. 9 is a chart illustrating paper feeding and paper conveyance timings in a printer according to a third embodiment.

Next, an image forming apparatus (printer 100) according to a third embodiment will be described with reference to FIG. 9. FIG. 9 is a chart illustrating paper feeding and paper conveyance timings in the printer 100 according to the third embodiment.

The printer 100 according to the present embodiment differs from the first and second embodiments in that the intermediate roller pair 4 is stopped after curl has been formed in the first sheet of paper P, and the intermediate roller pair 4 and resist roller pair 5 are rotated simultaneously. In other words, because time for absorbing delays in paper conveyance is provided before the resist roller pair 5 sends out the paper P in the printer 100 according to the third embodiment, the intermediate roller pair 4 is temporarily stopped for the first sheet of paper P. The intermediate roller pair 4 is not stopped for the second and subsequent sheets. However, the configuration of the printer 100 and the basic philosophy underlying paper feed start timing correction may be the same as in the first and second embodiments. Therefore, the descriptions of the first and second embodiments can be cited for points common to the first and second embodiments and the third embodiment; as such, description and illustration of any common points will be omitted, except when special descriptions are made.

The conveyance method will be described with reference to FIG. 9. The first line at the top of FIG. 9 depicts a signal indicating to rotate or stop the paper feeding roller 22 issued by the engine control part 9 to the electromagnetic paper feeding roller clutch 23. The second line in FIG. 9 depicts a signal indicating to rotate or stop the intermediate rollers issued by the engine control part 9 to the electromagnetic intermediate roller clutch 41. The third line from the top in FIG. 9 depicts changes in the output of the resist sensor S1. The lowest line in FIG. 9 depicts a signal indicating to rotate or stop the resist roller pair 5 issued by the engine control part 9 to the electromagnetic resist roller clutch 51. The above points are identical to the first embodiment shown in FIG. 4.

Next, the timing charts will be described in terms of the passage of time. First, the engine control part 9 rotates the paper feeding roller 22 in order to convey the first sheet of paper (t5 in FIG. 9). As the first sheet of paper is being fed, the engine control part 9 rotates the intermediate roller pair 4 (t6 in FIG. 9).

The paper P supplied from the paper feeding part 2 is conveyed by the intermediate roller pair 4, resulting in the paper P arriving at the resist sensor S1. The engine control part 9 recognizes changes in the output of the resist sensor S1, and recognizes when the paper has arrived at the resist sensor S1 (t7 in FIG. 9). After the paper arrives at the resist sensor S1, the engine control part 9 rotates the intermediate roller pair 4 with the resist roller pair in a stopped state until a predetermined curl generation time W1 (the period between t7 and t8 in FIG. 9) has passed. The paper P is thereby curled.

Once the curl generation time W1 has passed after the resist sensor S1 detects the arrival of the paper, the engine control part 9 stops the intermediate roller pair 4 (t8 in FIG. 9). The engine control part 9 then rotates the resist roller pair 5 and intermediate roller pair 4 (t9 in FIG. 9). The need to begin rotating the resist roller pair 5 is thereby obviated by the engine control part 9 reducing the time between t8 and t9, even when the arrival of the first sheet of paper at the resist roller pair 5 is delayed. For the second and subsequent sheets, the intermediate roller pair 4 continues to rotate, and the paper feed start timing is corrected on the basis of the sheet interval time T2 and the conveyance measurement time T1, as in the case of the first and second embodiments.

In this way, the rotating body (intermediate roller pair 4) of the image forming apparatus (for example, the printer 100) according to the present embodiment temporarily stops rotating while the first sheet of paper of a job is being conveyed and continues to rotate for the second and subsequent sheets until all of the sheets of paper P remaining for the job have been conveyed, and the resist part (resist roller pair 5) begins to convey the paper after waiting for a predetermined curl generation time W1 once the detector (resist sensor S1) has detected the arrival of the paper. As a consequence thereof, wait time for the resist part (resist roller pair 5) is provided and the stopping time (wait time) of the resist part or rotating body is altered to absorb delayed paper arrivals in single-sheet print jobs, or for the first sheet of paper P in a multiple-sheet print job; and the resist part is capable of sending out the paper P at a timing coinciding with image formation beyond the resist part.

(Fourth Embodiment)

Figure 10:
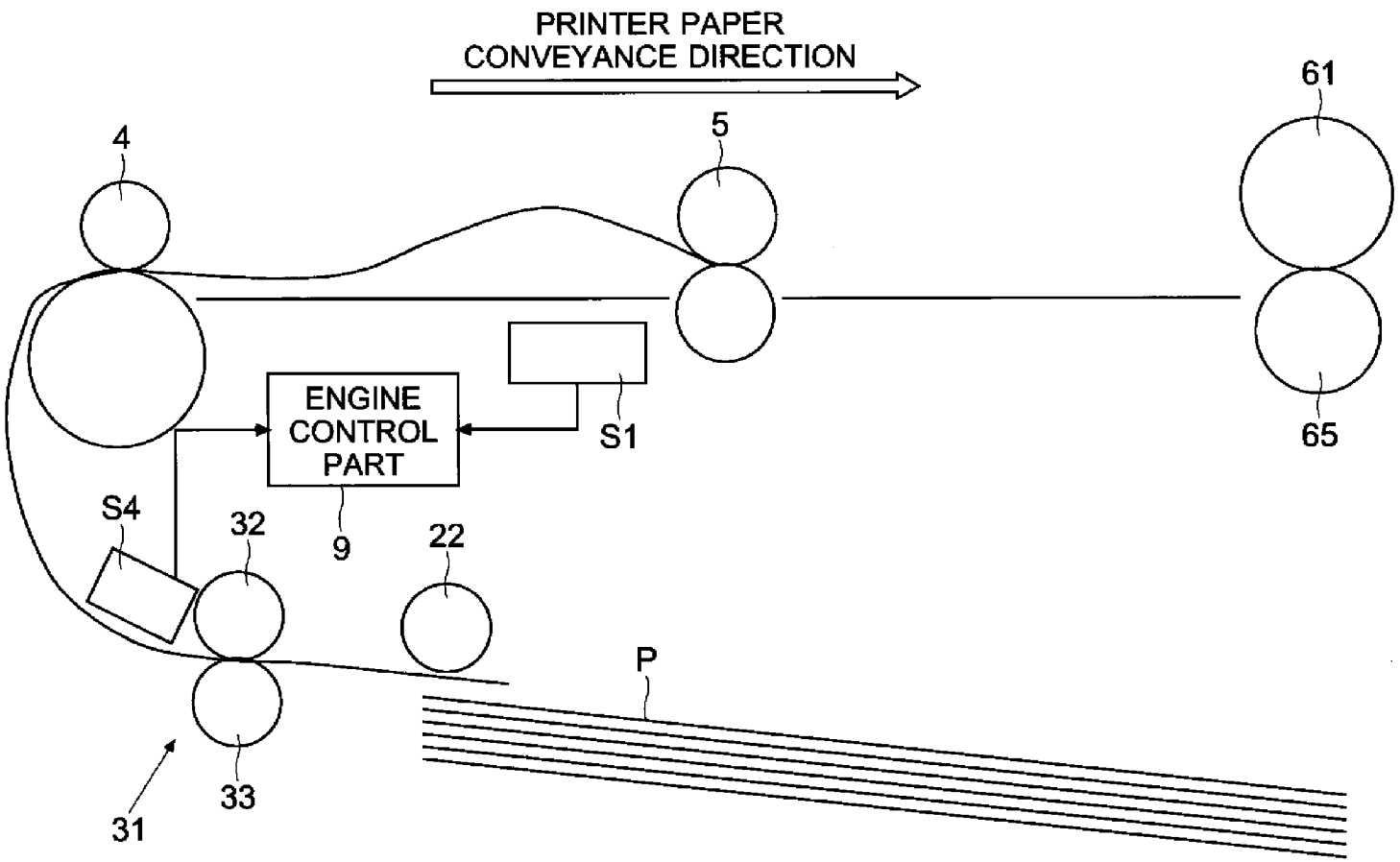
FIG. 10 is a chart illustrating a paper feeding sensor and generation of bending in paper in a printer according to a fourth embodiment.
Figure 11:
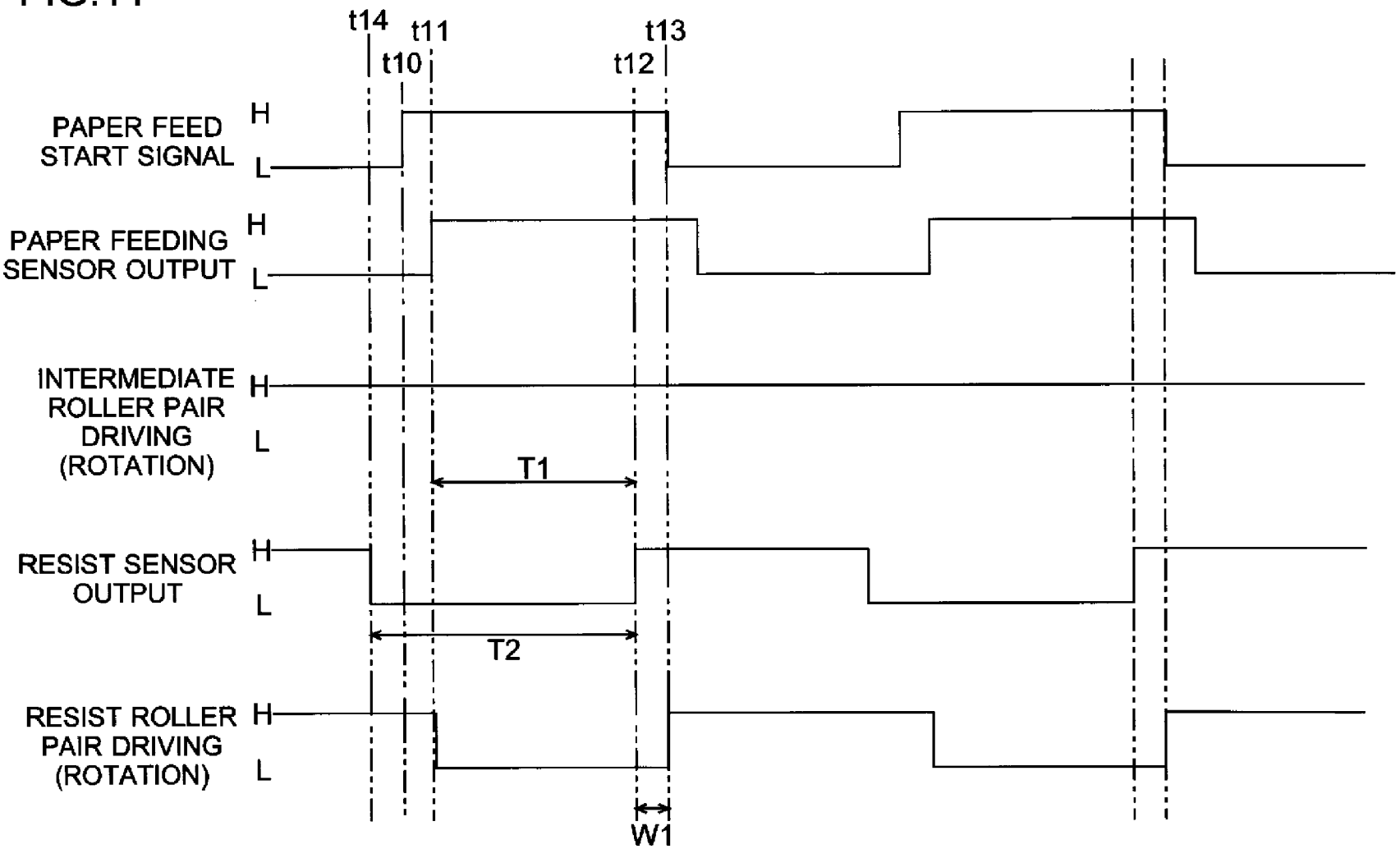
FIG. 11 is a chart illustrating paper feeding and paper conveyance timings in the printer according to the fourth embodiment.

Next, a printer 100 according to a fourth embodiment will be described with reference to FIG. 10 and FIG. 11. FIG. 10 is a chart illustrating a paper feeding sensor S4 and generation of bending in paper P in the printer 100 according to the fourth embodiment. FIG. 11 is a chart illustrating paper feeding and paper conveyance timings in the printer 100 according to the fourth embodiment.

In the printers 100 according to the first through the third embodiments, an example was described in which the time from when the engine control part 9 issues the ON signal (paper feed start signal) for the electromagnetic paper feeding roller clutch 23 rotating the paper feeding roller 22 to when the resist sensor S1 detects the arrival of the paper P was used for the measurement time T1. The fourth embodiment differs from the first through the third embodiments in that a paper feeding sensor S4 is provided between the intermediate roller pair 4 and the paper feeding roller 22, and the timer part 93 measures the time from when the paper feeding sensor S4 detects the arrival of the paper to when the resist sensor S1 detects the arrival of the paper P as measurement time T1. However, the configuration of the printer 100 and the basic philosophy underlying paper feed start timing correction may be the same as in the first through third embodiments. Therefore, the descriptions of the first through third embodiments can be cited for points in common with the first through third embodiments; as such, description and illustration of any common points will be omitted, except when special descriptions are made.

First, the position at which the paper feeding sensor S4 is disposed in the fourth embodiment will be described with reference to FIG. 10. As shown in FIG. 10, the paper feeding sensor S4 is provided upstream of the intermediate roller pair 4 in the paper conveyance direction. The paper feeding sensor S4 is, for example, an optical sensor, the output voltage of which differs according to whether the presence of paper P is or is not detected. The output from the paper feeding sensor S4 is inputted to the engine control part 9. The engine control part 9 recognizes the arrival or passage of paper at the paper feeding sensor S4 on the basis of the output from the paper feeding sensor S4. More specifically, the paper feeding sensor S4 can be provided, for example, in the vicinity of the pickup part 31, downstream thereof in the paper conveyance direction, as shown in FIG. 10.

Next, a process of measuring time in order to correct the drive timings of the various parts and paper feed start timing of the printer 100 according to the fourth embodiment will be described with reference to FIG. 11. FIG. 11 is a chart illustrating paper feeding and paper conveyance timings in the printer 100 according to the fourth embodiment.

The first line at the top of FIG. 11 depicts a signal indicating to rotate or stop the paper feeding roller 22 issued by the engine control part 9 to the electromagnetic paper feeding roller clutch 23. The third line in FIG. 11 depicts a signal indicating to rotate or stop the intermediate rollers issued by the engine control part 9 to the electromagnetic intermediate roller clutch 41. The fourth line from the top in FIG. 11 depicts changes in the output of the resist sensor S1. The lowest line in FIG. 11 depicts a signal indicating to rotate or stop the resist roller pair 5 issued by the engine control part 9 to the electromagnetic resist roller clutch 51. The above points are identical to FIG. 4.

The second line in FIG. 11 depicts the output of the paper feeding sensor S4. As shown in FIG. 11, the paper feeding sensor S4 of the present embodiment outputs high when the presence of paper P is detected, and low when the presence of paper P is not detected.

Next, the timing charts will be described in terms of the passage of time. First, the engine control part 9 rotates the paper feeding roller 22 in order to convey paper (t10 in FIG. 11). While the paper is being conveyed, the engine control part 9 continues to rotate the intermediate roller pair 4 (signal sent to the electromagnetic intermediate roller clutch 41 kept at high). As described in the case of the third embodiment, the intermediate roller pair 4 may be stopped for the first sheet of paper P.

The paper P supplied from the paper feeding part 2 is conveyed through the pickup part 31 toward the intermediate roller pair 4. As a result, the paper P arrives at the paper feeding sensor S4. The engine control part 9 recognizes changes in the output of the paper feeding sensor S4, and recognizes when the paper has arrived at the paper feeding sensor S4 (t11 in FIG. 11).

The paper P arriving at the paper feeding sensor S4 is conveyed by the intermediate roller pair 4, so that the paper P finally arrives at the resist sensor S1. The engine control part 9 recognizes changes in the output of the resist sensor S1, and recognizes when the paper has arrived at the resist sensor S1 (t12 in FIG. 11).

After the paper arrives at the resist sensor S1, the engine control part 9 keeps the resist roller pair 5 in a stopped state until a predetermined curl generation time W1 (the period between t12 and t13 in FIG. 11) has passed. The same amount of curl is thus imparted to the paper P at all times. Once the curl generation time W1 has passed after the resist sensor S1 detects the arrival of the paper, the engine control part 9 rotates the resist roller pair 5 (t13 in FIG. 11).

Next, time measured in order to correct the paper feed start timing will be described. In the present embodiment, the time from when the paper feeding sensor S4 detects the arrival of the paper to when the resist sensor S1 detects the arrival of the paper (measurement time T1; the time from t11 to t12 in FIG. 11) is measured. The time from when the resist sensor S1 detects the passage of the paper (i.e., detects the following end of the paper) to when the arrival of the next sheet of paper (i.e., the leading end of the paper is detected) is also measured (sheet interval time T2, the time from t14 to t12 in FIG. 11). The measurement time T1 and sheet interval time T2 are measured by, for example, the engine control part 9 of the timer part 93.

The engine control part 9 then identifies whether the arrival of the paper at the resist roller pair 5 is delayed or advanced using the measured measurement time T1 (the time from when the paper feeding sensor S4 detects the arrival of the paper to when the resist sensor S1 detects the arrival of the paper) and the sheet interval time T2.

The specific determination of delays or advances in paper conveyance and correction of the paper feed start timing using the measurement time T1, sheet interval time T2, reference measurement time R1, and reference sheet interval time R2 may be as in the case of the first embodiment. However, when the time from when the paper feeding sensor S4 is turned on until the resist sensor S1 is turned on is treated as the measurement time T1, as in the present embodiment, the reference measurement time is also set to the time from when the paper feeding sensor S4 is turned on until the resist sensor S1 is turned on. Alternatively, when the time from when the paper feeding sensor S4 is turned on until the resist sensor S1 is turned on is taken as measurement time T1, and the reference measurement time is taken as R1, the paper feed start timing may be advanced by an amount equal to T1−R1 (in a case where T1−R1 is negative, no correction is performed).

In this way, the image forming apparatus (for example, the printer 100) according to the present embodiment includes a paper feeding detector (the paper feeding sensor S4) disposed between the rotating body (intermediate roller pair 4) and the paper feeding part 2 for detecting the arrival and passage of the paper P, the timer part 93 measures the time from when the paper feeding detector detects the arrival of the paper to when the detector (resist sensor S1) detects the arrival of the paper as measurement time T1, and the reference measurement time is a predetermined reference time from when the paper feeding detector detects the arrival of the paper to when the detector detects the arrival of the paper. It is thereby possible to reduce the effects of shifts in the position of the leading end of the paper P placed in the paper feeding part 2 on the measurement time T1, and measure the amount of time from when the paper is fed to when the paper arrives at the resist part (resist roller pair 5). Thus, the paper feed start timing can be corrected with precision.

Next, another embodiment will be described. In the embodiments described above, the engine control part 9 was at once an identifier part identifying advances or delays in the arrival of the paper and the amount of time shift, a drive controller issuing a signal to the electromagnetic paper feeding roller clutch 23 and controlling the driving (rotation/stopping) of the paper feeding roller 22, and a counter part.

However, a portion other than the engine control part 9 may also bear the functions of the identifier part, drive controller, or counter part (for example, the control part 8 or a dedicated circuit, chip, or the like).

The foregoing has been a description based on embodiments according to the present disclosure, but the scope of the disclosure is not limited to these, and various modifications within the spirit of the disclosure may be made.

What is claimed is:

1. An image forming apparatus comprising:

an image-forming part for forming an image on paper;

a resist part for conveying paper toward the image-forming part;

a paper feeding part accommodating a plurality of sheets of paper and having a paper feeding rotating body, the paper feeding rotating body being rotated so as to send paper out toward the resist part;

a detector for detecting the arrival of paper at the resist part, the detector being provided upstream of the resist part in the paper conveyance direction;

a timer part for measuring a measurement time from when feeding of a second sheet of paper from the paper feeding part is begun to when the detector detects the arrival of the second sheet of paper, and a sheet interval time from when the detector detects the passage of a first sheet of paper immediately preceding the second sheet of paper to when the arrival of the second sheet of paper is detected;

an identifier part for referring to the measurement time and a predetermined reference measurement time acting as a reference for the measurement time, referring to the sheet interval time and a predetermined reference sheet interval time acting as a reference for the sheet interval time, deciding upon a correction to be performed upon the paper feed start timing, and delaying or advancing the paper feed start timing with respect to the current paper feed start timing for the paper feeding part on the basis of the decided-upon correction to be performed;

a rotating body for conveying toward the resist part paper supplied from the paper feeding part, the rotating body continuing to rotate while a plurality of sheets of paper is being conveyed;

the rotating body temporarily stopping rotating when the measured sheet interval time is short with respect to a sheet interval necessary downstream of the resist part in the paper conveyance direction; and the rotating body and resist part beginning to convey paper after waiting until the necessary sheet interval is reached.

2. The image forming apparatus according to claim 1;

the identifier part deciding, in a case where the measurement time or average of the measurement time less the reference measurement time is a value greater than zero, to perform correction by advancing the paper feed start timing with respect to the current paper feed start timing by an amount of time equal to the sheet interval time or average of the sheet interval time less the reference sheet interval time when the sheet interval time or average of the sheet interval time is longer than the reference sheet interval time; and deciding not to perform correction when the sheet interval time or average of the sheet interval time is equal to or less than the reference sheet interval time.

3. The image forming apparatus according to claim 1;

the identifier part finding a first value that is the reference measurement time minus the measurement time or average of the measurement time and a second value that is the reference sheet interval time less the sheet interval time or average of the sheet interval time when the measurement time or average of the measurement time less the reference measurement time is a value equal to or less than zero; deciding not to perform correction when the second value is equal to or greater than the first value; and deciding to perform correction by delaying the paper feed start timing with respect to the current paper feed start timing when the first value is greater than the second value.

4. The image forming apparatus according to claim 1;

the identifier part delaying the paper feed start timing with respect to the current paper feed start timing only when the measured sheet interval time is short with respect to the sheet interval necessary downstream of the resist part in a paper conveyance direction.

5. The image forming apparatus according to claim 1, further comprising:

a counter part for counting the number of sheets printed per unit of time, and an alert-issuing part for issuing an alert;

the alert-issuing part issuing an alert urging a user to check one or more of the paper feeding part, the rotating body, and the resist part when the number of sheets printed per unit of time counted by the counter part is less than a reference number of sheets printed acting as a predetermined reference for the number of sheets printed per unit of time even after the paper feeding part has advanced the paper feed start timing a predetermined number of times.

6. The image forming apparatus according to claim 1;

the identifier part deciding upon the correction to be performed every time the sheet interval time is measured; and the paper feeding part advancing or delaying the paper feed start timing every time the identifier part decides upon the correction to be performed.

7. The image forming apparatus according to claim 1, further comprising:

a storage part for storing a plurality of pages' worth of measurement results data for the sheet interval time and the measurement time;

the identifier part finding the average sheet interval time and the average measurement time for a plurality of pages' worth of the paper at a predetermined time, and deciding on the correction to be performed upon the paper feed start timing on the basis of the average sheet interval time and the average measurement time.

8. The image forming apparatus according to claim 7;

the paper feeding part having a paper accommodating body for accommodating a plurality of sheets of paper and an insertion/removal detector for detecting insertion or removal of the paper accommodating body; and the identifier part finding the average sheet interval time and the average measurement time for a plurality of pages' worth of paper when insertion or removal of the paper accommodating body has been detected, and deciding upon the correction to be performed upon the paper feed start timing on the basis of the average sheet interval time and average measurement time.

9. The image forming apparatus according to claim 7, further comprising:

a paper jam detection part for detecting paper jams occurring in a conveyance path;

the identifier part finding the average sheet interval time and the average measurement time for a plurality of pages' worth of paper when a paper jam has been detected, and deciding upon the correction to be performed upon the paper feed start timing on the basis of the average sheet interval time and average measurement time.

10. The image forming apparatus according to claim 1, further comprising:

a drive controller issuing a paper feed start signal indicating to begin rotating the paper feeding rotating body;

the timer part measuring as the measurement time the time from when the paper feed start signal is issued to when the detector detects the arrival of the paper; and the reference measurement time being a predetermined reference time from when the paper feeding direction signal is issued to when the detector detects the arrival of the paper.

11. The image forming apparatus according to claim 1, further comprising:

a paper feeding detector for detecting the arrival or passage of paper, the paper feeding detector provided between the rotating body and the paper feeding part;

the timer part measuring as the measurement time the time from when the paper feeding detector detects the arrival of the paper to when the detector detects the arrival of the paper; and the reference measurement time being a predetermined reference time from when the paper feeding detector detects the arrival of the paper to when the detector detects the arrival of the paper.

12. The image forming apparatus according to claim 1;

the rotating body temporarily stopping while a first sheet of paper of a job is being conveyed, and continuing to rotate for a second and subsequent sheets until all remaining sheets of paper in the job have been conveyed; and the resist part beginning to convey paper after a predetermined curl generation time after the detector has detected the arrival of paper.

13. The image forming apparatus according to claim 1, further comprising:

an input part for accepting settings for the thickness of the paper used in printing and accommodated in the paper feeding part;

the identifier part switching the reference measurement time and sheet interval time according to the inputted paper thickness setting.

* * * * *